US010336068B2

(12) United States Patent
Takeuchi

(10) Patent No.: US 10,336,068 B2
(45) Date of Patent: Jul. 2, 2019

(54) LIQUID JETTING APPARATUS AND METHOD OF COPING WITH FLOATING OF MEDIUM

(71) Applicant: FUJIFILM Corporation, Tokyo (JP)

(72) Inventor: Makoto Takeuchi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/047,018

(22) Filed: Jul. 27, 2018

(65) Prior Publication Data

US 2018/0370229 A1 Dec. 27, 2018

Related U.S. Application Data

(63) Continuation of application No. PCT/JP2017/008587, filed on Mar. 3, 2017.

(30) Foreign Application Priority Data

Mar. 11, 2016 (JP) ..... 2016-048507

(51) Int. Cl.
*B41J 25/308* (2006.01)
*B41J 2/135* (2006.01)
(Continued)

(52) U.S. Cl.
CPC ..... *B41J 2/135* (2013.01); *B41J 2/2114* (2013.01); *B41J 11/002* (2013.01);
(Continued)

(58) Field of Classification Search
CPC ..... B41J 2/135; B41J 25/3088; B41J 2/2114; B41J 11/002; B41J 2025/008; B41J 2202/21; B65H 7/02; B41M 7/009
See application file for complete search history.

(56) References Cited

U.S. PATENT DOCUMENTS 9,221,279 B2 * 12/2015 Houjou ..... B41J 11/002
9,815,307 B2 * 11/2017 Mueller ..... B41J 11/0095
(Continued)

FOREIGN PATENT DOCUMENTS

JP 2007136726 6/2007
JP 2008246879 10/2008
(Continued)

OTHER PUBLICATIONS

"International Search Report (Form PCT/ISA/210) of PCT/JP2017/008587," dated May 16, 2017, with English translation thereof, pp. 1-5.
"Written Opinion of the International Searching Authority (Form PCT/ISA/237) of PCT/JP2017/008587," dated May 16, 2017, with English translation thereof, pp. 1-12.

*Primary Examiner* — Yaovi M Ameh
(74) *Attorney, Agent, or Firm* — JCIPRNET

(57) ABSTRACT

There are provided a liquid jetting apparatus in which the deterioration of production efficiency is suppressed in a case in which the floating of a medium occurs, and a method of coping with the floating of a medium. A medium is fed; liquid is jetted to the medium, which is transported by a medium transport unit including a medium support surface on which the medium is supported and transporting the fed medium in a medium transport direction, by a liquid jet head; drying processing is performed on the medium, to which the liquid jetted from the liquid jet head adheres, at a position on the downstream side of the liquid jet head in the medium transport direction; and in a case in which the floating of the medium is detected at a position on the upstream side of the liquid jet head in the medium transport direction, the medium continues to be fed, the liquid jet head is moved to a retreat position from a liquid jet position, and the intensity of drying processing is suppressed in comparison with that in a liquid-drying processing-performing state in which drying processing is performed on the medium.

13 Claims, 13 Drawing Sheets

(51) Int. Cl.

| | |
|---|---|
| ***B65H 7/02*** | (2006.01) |
| ***B41J 11/00*** | (2006.01) |
| ***B41J 2/21*** | (2006.01) |
| *B41M 7/00* | (2006.01) |
| *B41J 25/00* | (2006.01) |

(52) U.S. Cl.
CPC ..... *B41J 25/3088* (2013.01); *B65H 7/02* (2013.01); *B41J 2025/008* (2013.01); *B41J 2202/21* (2013.01); *B41M 7/009* (2013.01)

(56) References Cited

U.S. PATENT DOCUMENTS

| | | | | |
|---|---|---|---|---|
| 2004/0233244 | A1 | 11/2004 | Elgee et al. | |
| 2008/0238959 | A1 | 10/2008 | Kato et al. | |
| 2012/0218328 | A1 | 8/2012 | Hattori et al. | |
| 2013/0044153 | A1* | 2/2013 | Sasaki | B41J 11/002 347/16 |
| 2016/0167410 | A1 | 6/2016 | Takada | |
| 2018/0001665 | A1* | 1/2018 | Isozaki | B41J 2/01 |

FOREIGN PATENT DOCUMENTS

| | | |
|---|---|---|
| JP | 2011126131 | 6/2011 |
| JP | 2012143944 | 8/2012 |
| JP | 2012187919 | 10/2012 |
| JP | 2015009545 | 1/2015 |

* cited by examiner

LIQUID JETTING APPARATUS AND METHOD OF COPING WITH FLOATING OF MEDIUM

CROSS-REFERENCE TO RELATED APPLICATIONS

The present application is a Continuation of PCT International Application No. PCT/JP2017/008587 filed on Mar. 3, 2017 claiming priority under 35 U.S.C § 119(a) to Japanese Patent Application No. 2016-048507 filed on Mar. 11, 2016. Each of the above applications is hereby expressly incorporated by reference, in their entirety, into the present application.

BACKGROUND OF THE INVENTION

1. Field of the Invention

The present invention relates to a liquid jetting apparatus and a method of coping with the floating of a medium, and more particularly, to a technique for coping with a case in which floating occurs on a medium.

2. Description of the Related Art

In a case in which mediums are successively fed and liquid is successively jetted to the plurality of mediums in a liquid jetting apparatus including liquid jet heads, the floating of a medium may occur. For example, in a case in which the floating of a medium occurs, the medium is in contact with the liquid jetting surface of the liquid jet head. For this reason, the liquid jetting surface of the liquid jet head may be damaged.

A technique for making the liquid jet head retreat to avoid the contact between the liquid jetting surface of the liquid jet head and the medium in a case in which the floating of a medium is detected is known.

JP2007-136726A discloses a liquid jetting apparatus that includes a plurality of liquid jet heads. The liquid jetting apparatus disclosed in JP2007-136726A stops transporting a medium and moves the liquid jet heads in a direction in which the liquid jet heads are away from a transport belt for transporting the medium in a case in which the floating of the medium is detected.

Since the liquid jet heads are moved in the direction in which the liquid jet heads are away from the transport belt for transporting the medium, a collision between the liquid jet heads and the medium is avoided. Further, since the transport of the medium is stopped, the generation of waste sheets is suppressed.

The term of "liquid jet head" in this specification corresponds to the term of "ink jet head" in JP2007-136726A. The term of "liquid jetting apparatus" in this specification corresponds to the term of "ink jet recording apparatus" in JP2007-136726A. The term of "medium" in this specification corresponds to the term of "sheet" in JP2007-136726A. The term of "the floating of a medium" in this specification corresponds to the term of "the floating of a sheet" in JP2007-136726A.

SUMMARY OF THE INVENTION

However, the liquid jetting apparatus disclosed in JP2007-136726A stops transporting a medium in a case in which the floating of the medium is detected. In this case, processing associated with drawing needs to be stopped.

For example, it is necessary to stop feeding a medium to stop transporting a medium. Since some time is taken until the processing associated with drawing is resumed in a case in which processing associated with drawing is stopped as described above, there is a concern that production efficiency may deteriorate.

The invention has been made in consideration of the above-mentioned circumstances, and an object of the invention is to provide a liquid jetting apparatus in which the deterioration of production efficiency is suppressed in a case in which the floating of a medium occurs, and a method of coping with the floating of a medium.

The following aspects of the invention are provided to achieve the object.

A liquid jetting apparatus of a first aspect comprises: a medium feed unit that feeds a medium; a medium transport unit that includes a medium support surface on which the medium fed by the medium feed unit is supported and transports the medium, which is fed by the medium feed unit, in a medium transport direction; a liquid jet head that jets liquid to the medium transported by the medium transport unit; a head moving unit that moves the liquid jet head between a liquid jet position where liquid is jetted to the medium and a retreat position which is more distant from the medium transport unit than the liquid jet position; a liquid-drying processing section that performs drying processing on the medium to which the liquid jetted from the liquid jet head adheres and is disposed at a position on a downstream side of the liquid jet head in the medium transport direction; a medium floating detection unit that is disposed at a position on an upstream side of the liquid jet head in the medium transport direction, and detects a floating of the medium indicating whether or not at least a part of the medium transported by the medium transport unit is away from the medium support surface by a distance equal to or longer than a predetermined distance; a medium feed control unit that allows the medium feed unit to continue to feed the medium in a case in which the floating of the medium transported by the medium transport unit is detected by the medium floating detection unit; a head movement control unit that allows the head moving unit to move the liquid jet head to the retreat position from the liquid jet position in a case in which the floating of the medium transported by the medium transport unit is detected by the medium floating detection unit; and a liquid-drying processing control unit that switches the liquid-drying processing section to a liquid-drying processing-suppression state in which an intensity of drying processing is suppressed in comparison with that in a liquid-drying processing-performing state in which drying processing is performed on the medium, in a case in which the floating of the medium transported by the medium transport unit is detected by the medium floating detection unit.

According to the first aspect, since a medium continues to be fed in a case in which the floating of the medium is detected, a period between the elimination of the floating of the medium and a time when the jet of liquid can be resumed can be made shorter than that in a case in which the feed of a medium is interrupted or stopped at the time of detection of the floating of the medium. As a result, the deterioration of production efficiency can be suppressed.

Further, since the liquid-drying processing section is switched to the liquid-drying processing-suppression state in which the intensity of liquid-drying processing is suppressed in a case in which the floating of a medium is detected, a period between the elimination of the floating of the medium and the resumption of the drying processing of the liquid-drying processing section can be made shorter than that in a case in which the liquid-drying processing section is completely stopped at the time of detection of the floating of the medium. As a result, the deterioration of production efficiency can be suppressed.

It is preferable that the liquid jetting apparatus includes a jetting control unit for controlling the jet of the liquid jet head. The jetting control unit allows the liquid jet head to be in a state in which the liquid jet head can jet liquid in a case in which the liquid jet head is disposed at the liquid jet position, and allows the liquid jet head to be in a state in which the jet of liquid from the liquid jet head is stopped in a case in which the liquid jet head is disposed at the retreat position.

According to a second aspect, the liquid jetting apparatus of the first aspect may further comprise a jetting state detection unit that detects whether or not a state of the liquid jet head is a state in which predetermined jetting quality is obtained, the head movement control unit may allow the head moving unit to move the liquid jet head to the liquid jet position from the retreat position in a case in which an elimination of the floating of the medium transported by the medium transport unit is detected by the medium floating detection unit, and the liquid-drying processing control unit may switch the liquid-drying processing section to the liquid-drying processing-performing state from the liquid-drying processing-suppression state in a case in which the jetting state detection unit determines that the state of the liquid jet head is a state in which predetermined jetting quality is obtained.

According to the second aspect, the jet of liquid is resumed in a case in which it is determined that the state of the liquid jet head is a state in which predetermined jetting quality is obtained. Accordingly, the deterioration of jetting quality, which is caused by an influence in at least one of a case in which the liquid jet head is made to retreat to the retreat position or a case in which the liquid jet head returns to the liquid jet position, can be suppressed.

According to a third aspect, in the liquid jetting apparatus of the second aspect, the jetting state detection unit may include a pressure detection unit that detects internal pressure of the liquid jet head, and the head movement control unit may determine that the state of the liquid jet head is a state in which predetermined jetting quality is obtained in a case in which the elimination of the floating of the medium transported by the medium transport unit is detected by the medium floating detection unit and the internal pressure of the liquid jet head detected by the pressure detection unit is in a predetermined range.

According to the third aspect, the jetting state of the liquid jet head in which the internal pressure of the liquid jet head is used can be detected.

The pressure in a common flow passage, which communicates with a plurality of jetting elements, of the internal flow passage of the liquid jet head can be applied as the internal pressure of the liquid jet head.

According to a fourth aspect, the liquid jetting apparatus of any one of the first to third aspects may further comprise: a treatment liquid-application section that applies treatment liquid, which aggregates or insolubilizes the liquid jetted to the medium, to the medium and is disposed at a position on an upstream side of the liquid jet head in the medium transport direction; and a treatment liquid-application control unit that controls an operation of the treatment liquid-application section and performs switching between a treatment liquid-application processable state which is a state in which the treatment liquid is capable of being applied to the medium from the treatment liquid-application section and a treatment liquid-application standby-fixed state in which the treatment liquid-application section is fixed in a treatment liquid-application standby state which is a state in which the treatment liquid is not applied to the medium from the treatment liquid-application section. The treatment liquid-application control unit may switch the treatment liquid-application section to the treatment liquid-application standby-fixed state from the treatment liquid-application processable state in a case in which the floating of the medium is detected by the medium floating detection unit.

According to the fourth aspect, in an aspect in which the treatment liquid-application section for applying treatment liquid, which aggregates or insolubilizes the liquid jetted to the medium, to the medium is provided, a period between the elimination of the floating of the medium and a time when the jet of liquid can be resumed can be made shorter than that in a case in which the treatment liquid-application section is stopped. As a result, the deterioration of production efficiency is suppressed.

According to a fifth aspect, in the liquid jetting apparatus of the fourth aspect, the treatment liquid-application section may include an application member that is in contact with the medium to apply the treatment liquid to the medium. In a case in which the treatment liquid-application section is in the treatment liquid-application processable state, the treatment liquid-application control unit may move the application member from a standby position, which is distant from a treatment liquid-application position where the application member and the medium are in contact with each other, to the treatment liquid-application position at a timing when the medium enters a treatment liquid-application region of the treatment liquid-application section and may move the application member to the standby position from the treatment liquid-application position at a timing when the medium gets out of the treatment liquid-application region of the treatment liquid-application section.

According to the fifth aspect, in the treatment liquid-application section that makes the application member be in contact with the medium in a case in which treatment liquid is to be applied to the medium and that makes the application member not be in contact with the medium in a case in which treatment liquid is not to be applied to the medium, the treatment liquid-application device can be switched to the treatment liquid-application standby-fixed state from the treatment liquid-application processable state in a case in which the floating of the medium is detected.

According to a sixth aspect, in the liquid jetting apparatus of the fifth aspect, the treatment liquid-application control unit may switch the treatment liquid-application section to the treatment liquid-application processable state from the treatment liquid-application standby-fixed state in a case in which an elimination of the floating of the medium transported by the medium transport unit is detected by the medium floating detection unit.

According to the sixth aspect, in the treatment liquid-application section that makes the application member be in contact with the medium in a case in which treatment liquid is to be applied to the medium and that makes the application member not be in contact with the medium in a case in which treatment liquid is not to be applied to the medium, the treatment liquid-application device can be switched to the treatment liquid-application processable state from the treatment liquid-application standby-fixed state in a case in which the floating of the medium is detected.

According to a seventh aspect, the liquid jetting apparatus of any one of the fourth to sixth aspects may further include a treatment liquid-drying processing section and a treatment liquid-drying processing control unit. The treatment liquid-drying processing section may perform drying processing on the medium to which the treatment liquid is applied by the treatment liquid-application section. The treatment liquid-drying processing section may be disposed at a position on a downstream side of the treatment liquid-application section in the medium transport direction and on an upstream side of the liquid jet head in the medium transport direction. The treatment liquid-drying processing control unit may switch the treatment liquid-drying processing section to a treatment liquid-drying processing-suppression state in which an intensity of drying processing is suppressed in comparison with that in a treatment liquid-drying processing-performing state in which drying processing is performed on the medium, in a case in which the floating of the medium transported by the medium transport unit is detected by the medium floating detection unit.

According to the seventh aspect, in an aspect in which the treatment liquid-drying processing section for drying the treatment liquid applied to the medium is provided, a period between the elimination of the floating of the medium and a time when the jet of liquid can be resumed can be made shorter than that in a case in which the treatment liquid-drying processing section is stopped. As a result, the deterioration of production efficiency is suppressed.

According to an eighth aspect, the liquid jetting apparatus of the seventh aspect may further comprise a jetting state detection unit that detects whether or not a state of the liquid jet head is a state in which predetermined jetting quality is obtained, and the treatment liquid-drying processing control unit may switch the treatment liquid-drying processing section to the treatment liquid-drying processing-performing state from the treatment liquid-drying processing-suppression state in a case in which the jetting state detection unit determines that the state of the liquid jet head is a state in which predetermined jetting quality is obtained.

According to the eighth aspect, in an aspect in which the treatment liquid-drying processing section for drying the treatment liquid applied to the medium is provided, the treatment liquid-drying processing section can be switched to the treatment liquid-drying processing-performing state from the treatment liquid-drying processing-suppression state in a case in which it is determined that the state of the liquid jet head is a state in which predetermined jetting quality is obtained.

According to a ninth aspect, in the liquid jetting apparatus of any one of the first to eighth aspects, the liquid-drying processing section may include a heater radiating heat, and the liquid-drying processing control unit may suppress radiant energy of heat radiated from the heater in comparison with radiant energy of heat, which is radiated from the heater in the liquid-drying processing-performing state, at a timing when the liquid-drying processing control unit switches the liquid-drying processing section to the liquid-drying processing-suppression state.

According to the ninth aspect, since the radiant energy of heat radiated from the heater is suppressed, the liquid-drying processing-suppression state can be realized.

According to a tenth aspect, in the liquid jetting apparatus of any one of the first to ninth aspects, the liquid-drying processing section may include a fan that generates wind, and the liquid-drying processing control unit may suppress a flow rate of air sent from the fan in comparison with a flow rate of air, which is sent from the fan in the liquid-drying processing-performing state, at a timing when the liquid-drying processing control unit switches the liquid-drying processing section to the liquid-drying processing-suppression state.

According to the tenth aspect, since the flow rate of air sent from the fan is suppressed, the liquid-drying processing-suppression state can be realized.

According to an eleventh aspect, in the liquid jetting apparatus of any one of the first to tenth aspects, the liquid jet head may be an ink jet head that jets ink to a medium.

According to the eleventh aspect, in an aspect in which an ink jet head is provided as the liquid jet head, the same effects as the first aspect can be obtained.

According to a twelfth aspect, the liquid jetting apparatus of any one of the first to eleventh aspects may further comprise a waste sheet-number setting unit that sets the number of mediums passing through a liquid jet region of the liquid jet head in a head retreat period between a timing when the liquid jet head is moved to the retreat position from the liquid jet position by the head moving unit and a timing when the liquid jet head is moved to the liquid jet position from the retreat position by the head moving unit, by using the head retreat period, a feed timing of the medium fed by the medium feed unit, and a transport speed of the medium transported by the medium transport unit. The liquid-drying processing control unit may switch the liquid-drying processing section to the liquid-drying processing-suppression state in a period in which mediums of which the number is set by the waste sheet-number setting unit from mediums detected by the medium floating detection unit pass through a drying processing region of the liquid-drying processing section.

According to the twelfth aspect, since the number of waste sheets passing through the jet region of the liquid jet head is set in the head retreat period, the liquid-drying processing section can be switched to the liquid-drying processing-suppression state and the liquid-drying processing-performing state on the basis of the number of waste sheets.

A method of coping with floating of a medium according to a thirteenth aspect comprises: a medium feeding step of feeding a medium; a liquid jetting step of jetting liquid to the medium, which is fed in the medium feeding step and is transported by a medium transport unit, by a liquid jet head, the medium transport unit including a medium support surface on which the medium fed in the medium feeding step is supported and transporting the medium in a medium transport direction; a liquid-drying processing step of performing drying processing on the medium, to which the liquid jetted from the liquid jet head adheres, at a position on a downstream side of the liquid jet head in the medium transport direction; a medium floating detection step of detecting a floating of the medium, which indicates whether or not at least a part of the medium transported by the medium transport unit is away from the medium support surface by a distance equal to or longer than a predetermined distance, at a position on an upstream side of the liquid jet head in the medium transport direction; and a head moving step of moving the liquid jet head between a liquid jet position where the liquid is jetted to the medium and a retreat position that is more distant from the medium transport unit than the liquid jet position. In a case in which the floating of the medium transported by the medium transport unit is detected in the medium floating detection step, the medium continues to be fed in the medium feeding step, the head moving step is performed to move the liquid jet head to the retreat position from the liquid jet position, and a state is switched to a liquid-drying processing-suppression state in which an intensity of drying processing is suppressed in comparison with that in a liquid-drying processing-performing state in which drying processing is performed on the medium in the liquid-drying processing step.

According to the thirteenth aspect, the same effects as the first aspect can be obtained.

In the thirteenth aspect, the same items as the items specified in the second to twelfth aspects can be appropriately combined. In this case, components taking on the processing or functions specified in the liquid jetting apparatus can be grasped as components, which take on processing or functions corresponding to the above-mentioned processing or functions, of the method of coping with the floating of a medium.

According to the invention, since a medium continues to be fed in a case in which the floating of a medium is detected, a period between the elimination of the floating of the medium and a time when the jet of liquid can be resumed can be made shorter than that in a case in which the feed of a medium is interrupted or stopped at the time of detection of the floating of the medium. As a result, the deterioration of production efficiency can be suppressed.

Further, since a liquid-drying processing section is switched to a liquid-drying processing-suppression state in which the intensity of liquid-drying processing is suppressed in a case in which the floating of a medium is detected, a period between the elimination of the floating of the medium and the resumption of the drying processing of the liquid-drying processing section can be made shorter than that in a case in which the liquid-drying processing section is completely stopped at the time of detection of the floating of the medium. As a result, the deterioration of production efficiency can be suppressed.

DESCRIPTION OF THE PREFERRED EMBODIMENTS

Preferred embodiments of the invention will be described in detail below with reference to the accompanying drawings.

[Description of Ink Jet Recording Apparatus]

<Overall Configuration>

Figure 1:
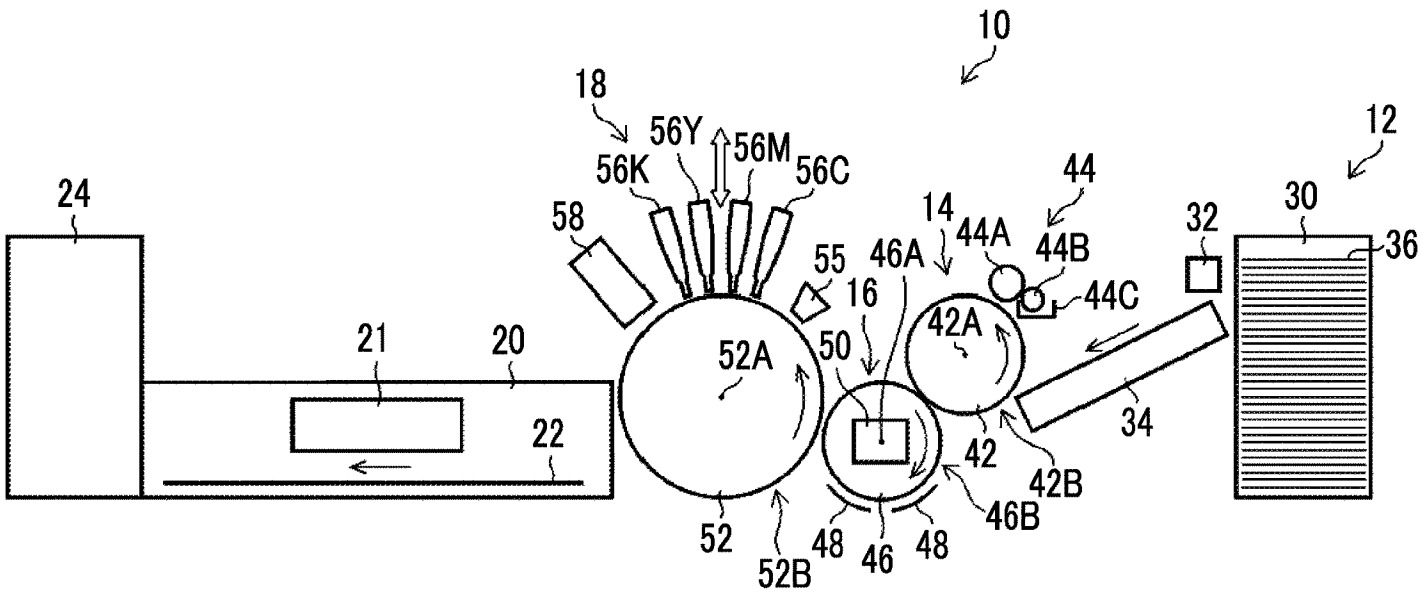
FIG. 1 is a diagram showing the schematic configuration of the entire ink jet recording apparatus.

FIG. 1 is a diagram showing the schematic configuration of the entire ink jet recording apparatus. The ink jet recording apparatus 10 shown in FIG. 1 is an image forming apparatus that applies an ink jet system to perform drawing on a sheet-like medium.

The sheet-like medium is a material on which drawing can be performed or a pattern can be formed using an ink jet system, such as paper, a sheet-like fiber, a sheet-like metal material, or a sheet-like resin material. Hereinafter, the term of "medium" can be substituted with the term of "sheet". Further, the term of "image forming" can be substituted with the term of "drawing".

The ink jet recording apparatus 10 shown in FIG. 1 includes a sheet feed unit 12, a treatment liquid-application section 14, a treatment liquid-drying processing section 16, a drawing unit 18, an ink-drying processing section 20, and a sheet discharge unit 24. The sheet feed unit 12, the treatment liquid-application section 14, the treatment liquid-drying processing section 16, the drawing unit 18, the ink-drying processing section 20, and the sheet discharge unit 24 are arranged along a sheet transport direction, which is the transport direction of a sheet 36, in the order of the sheet feed unit 12, the treatment liquid-application section 14, the treatment liquid-drying processing section 16, the drawing unit 18, the ink-drying processing section 20, and the sheet discharge unit 24.

The structure of each section of the ink jet recording apparatus 10 will be described in detail below. The ink jet recording apparatus 10 shown in FIG. 1 is one aspect of a liquid jetting apparatus. Ink is one aspect of liquid.

<Sheet Feed Unit>

The sheet feed unit 12 shown in FIG. 1 includes a stocker 30, a sheet feed sensor 32, and a feeder board 34. Sheets 36 are stored in the stocker 30. The sheet feed sensor 32 detects the sheet 36 taken out from the stocker 30.

An optical sensor can be applied as the sheet feed sensor 32, and examples of the optical sensor include a light projection type passage sensor that includes a light projecting part and a light receiving part. Information on a sheet 36, which is acquired using the sheet feed sensor 32, can be used for the measurement of the number of sheets 36 that are fed from the sheet feed unit 12.

Further, in a case in which a plurality of sheets 36 are successively fed, information on a sheet 36, which is acquired using the sheet feed sensor 32, can be applied to the detection of the feed timing of each sheet 36. The feed timing of the sheet 36 is one aspect of the feed timing of a medium.

The feeder board 34 corrects the posture of a sheet 36 that is taken out from the stocker 30. The sheet 36 of which the posture is corrected by the feeder board 34 is delivered to the treatment liquid-application section 14. An arrow line, which is shown above the feeder board 34, indicates the sheet transport direction on the feeder board 34.

A sheet 36 is one aspect of a medium. A sheet, which uses a material other than paper, such as sheet-like metal or a sheet-like resin, may be applied instead of a sheet 36. The medium is a concept that includes a base material or a substrate. The sheet feed unit 12 is one aspect of a medium feed unit.

<Treatment Liquid-Application Section>

The treatment liquid-application section 14 shown in FIG. 1 includes a treatment liquid drum 42 and a treatment liquid-application device 44. The treatment liquid drum 42 has a columnar shape. The treatment liquid drum 42 is supported so as to be rotatable about a columnar central shaft as a rotating shaft 42A.

The entire length of the treatment liquid drum 42 in a direction parallel to the rotating shaft 42A corresponds to the maximum width of a sheet 36 having the maximum size. The width of a sheet 36 is the length of the sheet 36 in a direction orthogonal to the sheet transport direction. A direction parallel to the rotating shaft 42A of the treatment liquid drum 42 in FIG. 1 is a direction perpendicular to the plane of FIG. 1.

The term of "orthogonal" or "perpendicular" in this specification includes "substantially orthogonal" or "substantially perpendicular" where the same effects as the effects, which are obtained in a case in which two directions cross each other at an angle of 90°, are obtained in a case in which two directions cross each other at an angle exceeding 90° or a case in which two directions cross each other at an angle less than 90°.

Further, the term of "parallel" in this specification includes "substantially parallel" where two directions are not parallel to each other but the same effects as the effects, which are obtained in a case in which the two directions are parallel to each other, are obtained. Furthermore, the term of "the same" in this specification includes "substantially the same" where components are different from each other but the same effects as the effects, which are obtained in a case in which the components are the same, are obtained.

The treatment liquid drum 42 includes a gripper (not shown). The gripper includes a plurality of claws that are arranged along the direction parallel to the rotating shaft 42A of the treatment liquid drum 42. The plurality of claws grips the front end portion of a sheet 36. The sheet 36 of which the front end portion is gripped by the gripper is supported on an outer peripheral surface 42B of the treatment liquid drum 42. The sheet 36, which is supported on the outer peripheral surface 42B of the treatment liquid drum 42, is not shown.

In a case in which the treatment liquid drum 42 is rotated while supporting the sheet 36 on the outer peripheral surface 42B, the treatment liquid drum 42 transports the sheet 36 along the outer peripheral surface 42B. An arrow line, which is shown in the treatment liquid drum 42, indicates the sheet transport direction in the treatment liquid-application section 14. The treatment liquid drum 42 is one aspect of a medium transport unit. The outer peripheral surface 42B of the treatment liquid drum 42 is a component of a medium support surface on which a medium is supported.

The treatment liquid-application device 44 includes an application roller 44A, a measurement roller 44B, and a treatment liquid container 44C. The application roller 44A is in contact with the sheet 36, which is transported by the treatment liquid drum 42, and applies treatment liquid, which is retained on the outer peripheral surface 42B of the treatment liquid drum 42, to the sheet 36.

The measurement roller 44B draws up treatment liquid, which is stored in the treatment liquid container 44C and aggregates or insolubilizes ink, by a predetermined volume, and supplies the treatment liquid to the application roller 44A. The sheet 36 to which the treatment liquid is applied by the treatment liquid-application section 14, is delivered to the treatment liquid-drying processing section 16.

The treatment liquid-application device 44 shown in FIG. 1 performs an operation for applying treatment liquid during a period in which the sheet 36 passes through a processing region. Further, during a period in which the sheet 36 does not pass through the processing region, the treatment liquid-application device 44 is in a standby state without performing an operation for applying treatment liquid. The details of the operation of the treatment liquid-application device 44 will be described later.

The application roller is one aspect of an application member. A structure, which includes an application roller and a measurement roller, is one aspect of an application member.

<Treatment Liquid-Drying Processing Section>

The treatment liquid-drying processing section 16 shown in FIG. 1 includes a treatment liquid-drying processing drum 46, transport guides 48, and a treatment liquid-drying processing device 50. The treatment liquid-drying processing drum 46 has a columnar shape. The treatment liquid-drying processing drum 46 is supported so as to be rotatable about a columnar central shaft as a rotating shaft 46A. A direction parallel to the rotating shaft 46A of the treatment liquid-drying processing drum 46 in FIG. 1 is a direction perpendicular to the plane of FIG. 1.

The treatment liquid-drying processing drum 46 includes a gripper that has the same structure as the gripper of the treatment liquid drum 42. The gripper of the treatment liquid-drying processing drum 46 is not shown. The gripper of the treatment liquid-drying processing drum 46 grips the front end portion of the sheet 36.

In a case in which the treatment liquid-drying processing drum 46 is rotated while gripping the front end portion of the sheet 36 by the gripper, the treatment liquid-drying processing drum 46 transports the sheet 36 along an outer peripheral surface 46B thereof. An arrow line, which is shown in the treatment liquid-drying processing drum 46, indicates the sheet transport direction in the treatment liquid-drying processing section 16.

The sheet 36, which is transported by the treatment liquid-drying processing drum 46, passes under the treatment liquid-drying processing drum 46.

The transport guides 48 are disposed on the lower side of the treatment liquid-drying processing drum 46. The transport guides 48 support the sheet 36 that passes under the treatment liquid-drying processing drum 46. The term of "lower" in this specification indicates the direction of gravity. Further, the term of "upper" indicates a direction opposite to the direction of gravity.

The treatment liquid-drying processing drum 46 and the transport guides 48 are components of the medium transport unit. The transport guides 48 are components of the medium support surface on which a medium is supported.

The treatment liquid-drying processing device 50 is disposed in the treatment liquid-drying processing drum 46. The treatment liquid-drying processing device 50 performs processing for drying treatment liquid on the sheet 36 that passes under the treatment liquid-drying processing drum 46 and that is supported by the transport guides 48.

As in the case of the ink-drying processing section 20, the treatment liquid-drying processing section 16 can be switched to a treatment liquid-drying processing-performing state and a treatment liquid-drying processing-suppression state.

The sheet 36, which has passed through the processing region of the treatment liquid-drying processing device 50, is delivered to the drawing unit 18. The sheet 36, which has been subjected to the processing for drying treatment liquid by the treatment liquid-drying processing device 50, is not shown in FIG. 1.

<Drawing Unit>

The drawing unit 18 shown in FIG. 1 includes a drawing drum 52. The drawing drum 52 has a columnar shape. The drawing drum 52 is supported so as to be rotatable about a columnar central shaft as a rotating shaft 52A. A direction parallel to the rotating shaft 52A of the drawing drum 52 in FIG. 1 is a direction perpendicular to the plane of FIG. 1.

The drawing drum 52 includes a plurality of suction holes on an outer peripheral surface 52B thereof. The plurality of suction holes are connected to a suction flow passage formed in the drawing drum 52. The suction flow passage formed in the drawing drum 52 is not shown. The outer peripheral surface 52B of the drawing drum 52 is a component of the medium support surface on which a medium is supported.

The suction flow passage formed in the drawing drum 52 is connected to a suction pressure generating device (not shown) through a pipe (not shown). In a case in which the suction pressure generating device is operated, the drawing drum 52 can generate suction pressure in the plurality of suction holes provided on the outer peripheral surface 52B.

The drawing drum 52 includes a gripper (not shown). Since the structure of the gripper of the drawing drum 52 is the same as the structure of the gripper of the treatment liquid drum 42 and the structure of the gripper of the treatment liquid-drying processing drum 46, the description thereof will be omitted.

The gripper of the drawing drum 52 is disposed in a recessed portion that is formed on the outer peripheral surface 52B of the drawing drum 52. The recessed portion formed on the outer peripheral surface 52B of the drawing drum 52 is not shown.

Suction pressure, which is generated in the plurality of suction holes provided on the outer peripheral surface 52B of the drawing drum 52, acts on the sheet 36 of which the front end portion is gripped by the gripper of the drawing drum 52, so that the sheet 36 is closely attached to the outer peripheral surface 52B of the drawing drum 52. The sheet 36, which is closely attached to the outer peripheral surface 52B of the drawing drum 52, is not shown in FIG. 1.

In a case in which the drawing drum 52 is rotated while the sheet 36 is closely attached to the outer peripheral surface 52B, the drawing drum 52 transports the sheet 36 along the outer peripheral surface 52B. An arrow line, which is shown in the drawing drum 52, indicates the sheet transport direction in the drawing unit 18. The drawing drum 52 is a component of the medium transport unit.

The drawing unit 18 shown in FIG. 1 includes a sheet floating sensor 55. The sheet floating sensor 55 detects the floating of a sheet 36 that is delivered to the drawing unit 18. The floating of a sheet 36 includes a state in which at least a part of the sheet 36 is away from a sheet support surface, which is the outer peripheral surface 52B of the drawing unit 18, by a distance equal to or larger than a predetermined distance due to the bending of a corner portion of the sheet 36, the curvature of the sheet 36, or the like.

The sheet floating sensor 55 is disposed at a position on the upstream side of a liquid jet head 56C that is disposed at the most upstream position in the drawing unit 18 in the sheet transport direction. The sheet floating sensor 55 detects the floating of a sheet 36 that does not yet enter the liquid jet region of the liquid jet head 56C.

The drawing unit 18 shown in FIG. 1 includes a liquid jet head 56C, a liquid jet head 56M, a liquid jet head 56Y, and a liquid jet head 56K. Each of the liquid jet heads 56C, 56M, 56Y, and 56K includes nozzle portions that jet liquid.

The nozzle portion is not shown in FIG. 1. The nozzle portion is denoted in FIG. 5 by reference numeral 281.

Here, an alphabet, which is added to the reference numeral of the liquid jet head, represents a color. C represents cyan. M represents magenta. Y represents yellow. K represents black.

The liquid jet heads 56C, 56M, 56Y, and 56K are arranged above the drawing drum 52. The liquid jet heads 56C, 56M, 56Y, and 56K are arranged along the sheet transport direction from the upstream side in the sheet transport direction in the order of the liquid jet heads 56C, 56M, 56Y, and 56K.

An ink jet head may be applied as each of the liquid jet heads 56C, 56M, 56Y, and 56K. The liquid jet heads 56C, 56M, 56Y, and 56K jet liquid to one surface of the sheet 36 that is transported by the drawing drum 52. Jetted liquid is applied to one surface of the sheet 36, so that drawing is realized. One surface of the sheet 36 is the surface of the sheet 36 that is opposite to the surface of the sheet 36 supported by the drawing drum 52.

The liquid jet heads 56C, 56M, 56Y, and 56K are mounted on head moving units. The head moving units are not shown in FIG. 1. The head moving unit is denoted in FIG. 7 by reference numeral 400. The detail of the head moving unit will be described later.

The drawing unit 18 shown in FIG. 1 includes an in-line sensor 58. The in-line sensor 58 is disposed at a position on the downstream side of the liquid jet head 56K that is disposed at the most downstream position in the sheet transport direction. The in-line sensor 58 includes an imaging element, a peripheral circuit of the imaging element, and a light source.

A solid-state imaging element, such as a CCD image sensor or a CMOS image sensor, can be applied as the imaging element. The imaging element, the peripheral circuit of the imaging element, and the light source are not shown. CCD is an abbreviation for Charge Coupled Device. CMOS is an abbreviation for Complementary Metal-Oxide Semiconductor.

The peripheral circuit of the imaging element includes a processing circuit for an output signal of the imaging element. Examples of the processing circuit include a filter circuit that removes noise components from the output signal of the imaging element, an amplifier circuit, a waveform shaping circuit, and the like. The filter circuit, the amplifier circuit, or the waveform shaping circuit is not shown.

The light source is disposed at a position where the light source can irradiate an object, which is to be read by the in-line sensor, with illumination light. An LED, a lamp, or the like can be applied as the light source. LED is an abbreviation for light emitting diode.

Figure 8:
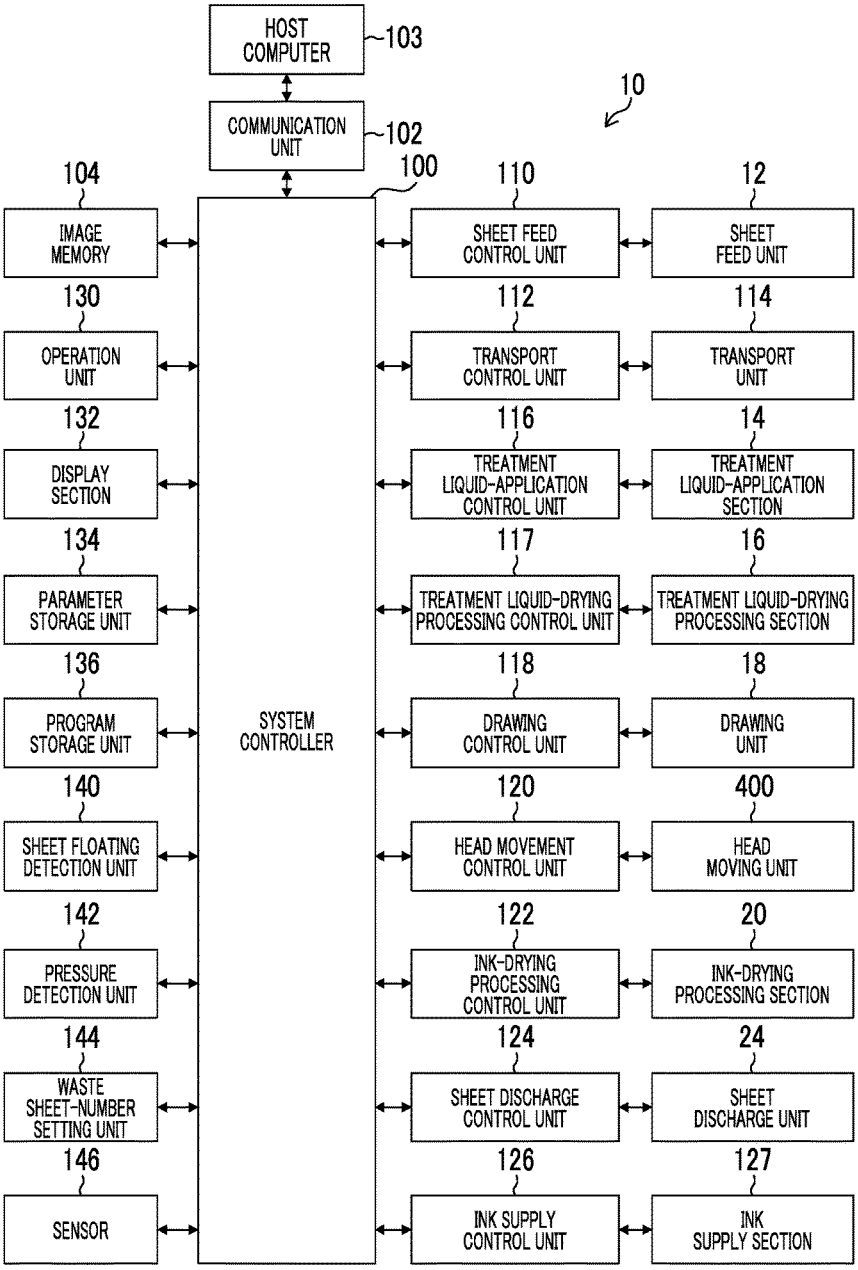
FIG. 8 is a block diagram showing the configuration of a control system.

An imaging signal, which is output from the in-line sensor 58, is sent to a system controller 100 shown in FIG. 8. An imaging signal, which is output from the in-line sensor 58, can be used for the detection of abnormalities of the liquid jet heads 56C, 56M, 56Y, and 56K, the detection of density unevenness, and the like. The sheet 36 subjected to drawing in the drawing unit 18 is delivered to the ink-drying processing section 20. The sheet 36 subjected to drawing in the drawing unit 18 is not shown.

<Ink-Drying Processing Section>

The ink-drying processing section 20 shown in FIG. 1 includes a drying processing device 21 and a sheet transport member 22. The drying processing device 21 is disposed above the sheet transport member 22 that transports a sheet in the ink-drying processing section 20.

The drying processing device 21 performs drying processing on the sheet 36 to which ink is made to adhere by the drawing unit 18 and which is transported by the sheet transport member 22. A heater that radiates heat or a fan that generates wind can be applied as the drying processing device 21. The drying processing device 21 may include both a heater and a fan. An infrared heater, an ultraviolet lamp, or the like can be applied as the heater.

The sheet transport member 22 transports the sheet 36 in the ink-drying processing section 20. A chain transport, a belt transport, a roller transport, or the like can be applied as the sheet transport member 22. The sheet transport member 22 is a component of the medium transport unit. The sheet 36, which has been subjected to drying processing by the drying processing device 21, is delivered to the sheet discharge unit 24.

The drying processing device 21 can be switched to an ink-drying processing-performing state that is a state in which processing for drying ink is performed and an ink-drying processing-suppression state that is a state in which substantive processing for drying ink is not performed.

The ink-drying processing-performing state is a state in which drying processing is performed under a set drying processing condition. The ink-drying processing-suppression state is a state in which at least one of setting the temperature of the heater, setting the temperature of dry gas, or setting the flow rate of dry gas is lowered in the ink-drying processing-performing state.

Examples of the drying processing-suppression state include the turn-off of the heater of the drying processing device 21 and the turn-off of the fan. Further, other examples of the drying processing-suppression state include blocking that is performed between the drying processing device 21 and a sheet 36 by a blocking member, such as a shutter.

In other words, the drying processing device 21, which is in the ink-drying processing-suppression state, is in an unstopped state in which a system is activated. Examples of a state in which the system is activated include a state in which a control section for controlling the drying processing device 21 is activated. The control section for controlling the drying processing device 21 is shown in FIG. 8 as an ink-drying processing control unit 122.

Furthermore, the drying processing device 21, which is in the ink-drying processing-suppression state, is in a state in which the intensity of the drying processing is made lower than that in the ink-drying processing-performing state in which the drying processing is performed on the sheet 36. The state in which the intensity of drying processing is made lower is a heat-remaining state in which the radiant energy of heat radiated from the heater is reduced or a state in which the flow rate of air sent from the fan is reduced.

Moreover, the drying processing device 21, which is in the ink-drying processing-suppression state, is in a state in which substantive drying processing is not performed. The sheet 36 having passed through the processing region of the drying processing device 21, which is in the ink-drying processing-suppression state, is not subjected to substantive drying processing as in the case in which drying processing is not performed.

The sheet 36 having passed through the processing region of the ink-drying processing section 20 is transported to the sheet discharge unit 24. The sheet 36, which is subjected to the processing for drying ink by the ink-drying processing section 20, is not shown in FIG. 1. The ink-drying processing section is one aspect of a liquid-drying processing section. The ink-drying processing-performing state is one aspect of a liquid-drying processing-performing state. The ink-drying processing-suppression state is one aspect of a liquid-drying processing-suppression state.

<Sheet Discharge Unit>

The sheet 36, which has been subjected to drying processing by the ink-drying processing section 20, is stored in the sheet discharge unit 24 shown in FIG. 1. The sheet discharge unit 24 classifies a sheet 36 that has been subjected to normal drawing and a sheet 36 that is a waste sheet.

Here, the waste sheet includes a sheet 36 that is determined as a sheet of which the floating occurs. Further, the waste sheet may include a sheet 36 that is fed subsequently to a sheet 36 determined as a sheet of which the floating occurs and that is not subjected to normal processing in any one of the treatment liquid-application section 14, the treatment liquid-drying processing section 16, the drawing unit 18, and the ink-drying processing section 20.

An aspect in which a sorting device is provided may be provided as an example in which a sheet 36 subjected to normal drawing and a sheet 36 determined as a waste sheet are classified. In the aspect in which a sorting device is provided, a sheet 36 subjected to normal drawing and a waste sheet are stored at separate sheet discharge positions.

Further, an aspect in which a tape inserter for inserting a tape into a sheet 36 determined as a waste sheet is provided may be provided as another example. A sheet 36 into which a tape is inserted is removed in the aspect in which a tape inserter is provided. The removal of a sheet 36 into which a tape is inserted may be automatically performed and may be manually performed.

The ink jet recording apparatus 10, which includes the treatment liquid-application section 14 and the treatment liquid-drying processing section 16, is shown in FIG. 1, but the treatment liquid-application section 14 and the treatment liquid-drying processing section 16 may be omitted.

Further, in FIG. 1, a structure, such as a structure for transporting a sheet by a belt or a structure for transporting a sheet by a transport drum, may be applied as a structure that transports a sheet 36 subjected to drawing.

[Structure of Liquid Jet Head]

Next, the structures of the liquid jet heads shown in FIG. 1 will be described in detail.

<Overall Structure>

Figure 2:
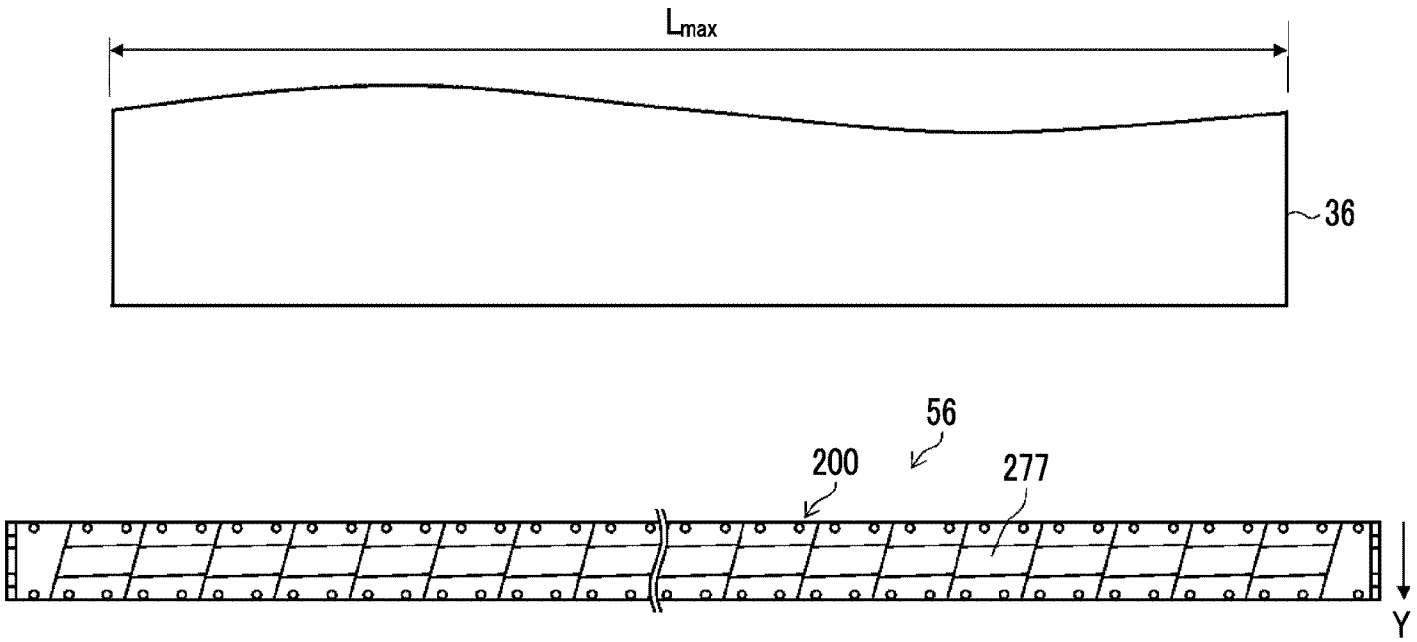
FIG. 2 is a perspective plan view of the liquid jetting surface of a liquid jet head.

FIG. 2 is a perspective plan view of the liquid jetting surface of the liquid jet head. The same structure can be applied to the liquid jet head 56C for jetting a cyan ink, the liquid jet head 56M for jetting a magenta ink, the liquid jet head 56Y for jetting a yellow ink, and the liquid jet head 56K for jetting a black ink that are shown in FIG. 1.

In a case in which the liquid jet heads 56C, 56M, 56Y, and 56K do not need to be distinguished from each other, the liquid jet heads are denoted by reference numeral 56.

As shown in FIG. 2, the liquid jet head 56 is a line type head. The line type head has a structure in which a plurality of nozzle portions are arranged over a length exceeding the entire width $L_{max}$ of the sheet 36 in a direction orthogonal to the sheet transport direction. The nozzle portions are not shown in FIG. 2. The nozzle portions are denoted in FIG. 5 by reference numeral 281.

A direction, which is denoted in FIG. 2 by reference letter X, is a direction orthogonal to the sheet transport direction. A direction, which is denoted in FIG. 2 by reference letter Y, is the sheet transport direction. Hereinafter, the direction orthogonal to the sheet transport direction may be referred to as a sheet width direction or an X direction. Further, the sheet transport direction may be referred to as a Y direction. The sheet transport direction corresponds to the medium transport direction.

The liquid jet head 56 shown in FIG. 2 includes a plurality of head modules 200. The plurality of head modules 200 are arranged in a line along the sheet width direction.

The same structure may be applied to the plurality of head modules 200. Further, the head module 200 may have a structure that can function alone as a liquid jet head.

The liquid jet head 56 in which the plurality of head modules 200 are arranged in a line along the sheet width direction is shown in FIG. 2, but the plurality of head modules 200 may be arranged in two lines so that the phases of the head modules 200 are shifted from each other in the sheet transport direction.

Figure 4:
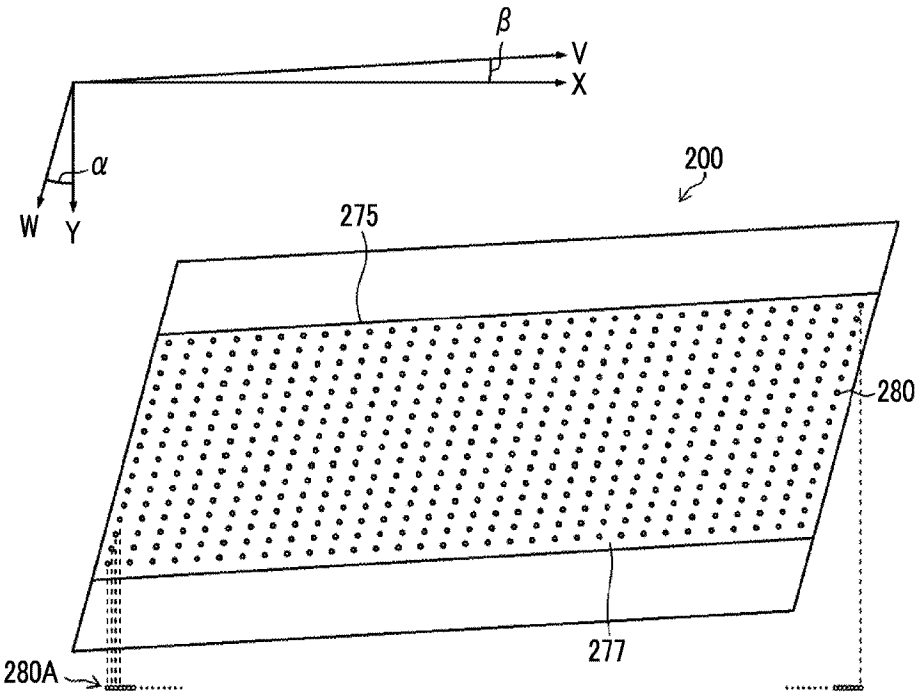
FIG. 4 is a plan perspective view of the liquid jetting surface of the head module.

A plurality of nozzle openings are arranged on liquid jetting surfaces 277 of the head modules 200 of the liquid jet head 56. The nozzle openings are not shown in FIG. 2. The nozzle openings are shown in FIG. 4 and denoted by reference numeral 280.

The full-line type liquid jet head 56 is exemplified in this embodiment, but a serial system may be applied. In the serial system, a short serial type liquid jet head shorter than the entire width $L_{max}$ of a sheet 36 is moved in the sheet width direction to perform drawing corresponding to one time in the sheet width direction, the sheet 36 is transported in the sheet transport direction by a certain distance so that drawing in the sheet width direction is formed in the next region in a case in which the drawing corresponding to one time in the sheet width direction is completed, and this operation is repeated so that drawing is performed on the entire surface of the sheet.

<Example of Structure of Head Module>

Next, the head module will be described in detail.

Figure 3:
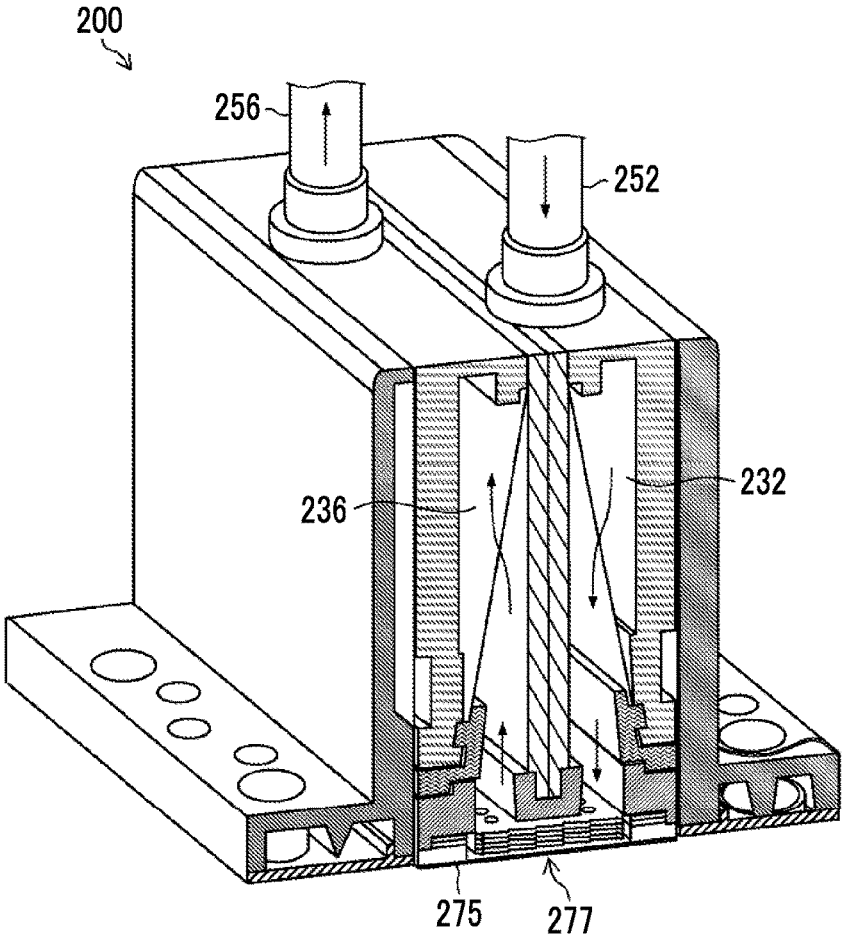
FIG. 3 is a perspective view of a head module including a partial cross-sectional view.

FIG. 3 is a perspective view of the head module including a partial cross-sectional view. FIG. 4 is a plan perspective view of the liquid jetting surface of the head module.

As shown in FIG. 3, the head module 200 includes an ink supply unit. The ink supply unit includes an ink supply chamber 232 and an ink circulation chamber 236.

The ink supply chamber 232 and the ink circulation chamber 236 are disposed on the side opposite to a liquid jetting surface 277 of a nozzle plate 275. The ink supply chamber 232 is connected to an ink tank (not shown) through a supply-side individual flow passage 252. The ink circulation chamber 236 is connected to a collection tank (not shown) through a collection-side individual flow passage 256.

Only some of the nozzle openings 280 are shown in FIG. 4. A plurality of nozzle openings 280 are two-dimensionally arranged on the liquid jetting surface 277 of the nozzle plate 275 of one head module 200.

That is, the head module 200 has the planar shape of a parallelogram that has a long-side end face extending in a V direction having an inclination of an angle β with respect to the X direction and a short-side end face extending in a W direction having an inclination of an angle α with respect to the Y direction, and the plurality of nozzle openings 280 are arranged in the form of a matrix in a row direction parallel to the V direction and a column direction parallel to the W direction.

The arrangement of the nozzle openings 280 is not limited to the aspect shown in FIG. 4, and the plurality of nozzle openings 280 may be arranged in a row direction parallel to the X direction and a column direction obliquely crossing the X direction.

Here, the matrix arrangement of the nozzle openings 280 is the arrangement of the nozzle openings 280 where the intervals between the nozzle openings 280 are uniform in an X-direction projection nozzle array 280A in which the plurality of nozzle openings 280 are arranged along the X direction in a case in which the plurality of nozzle openings 280 are projected to the X direction.

In the liquid jet head 56 shown in this embodiment, nozzle openings 280 belonging to one head module 200 and nozzle openings 280 belonging to the other head module 200 are mixed at a connecting portion between the adjacent head modules 200 in the X-direction projection nozzle array.

In a case in which there is no error in the mounting position of each head module 200, the nozzle openings 280, which belong to one head module 200, and the nozzle openings 280, which belong to the other head module 200, of a connecting region are arranged at the same positions. Accordingly, the arrangement of the nozzle openings 280 is uniform even in the connecting region.

In the following description, it is assumed that the head modules 200 of the liquid jet head 56 are mounted with no error in the mounting positions thereof.

<Internal Structure of Head Module>

Figure 5:
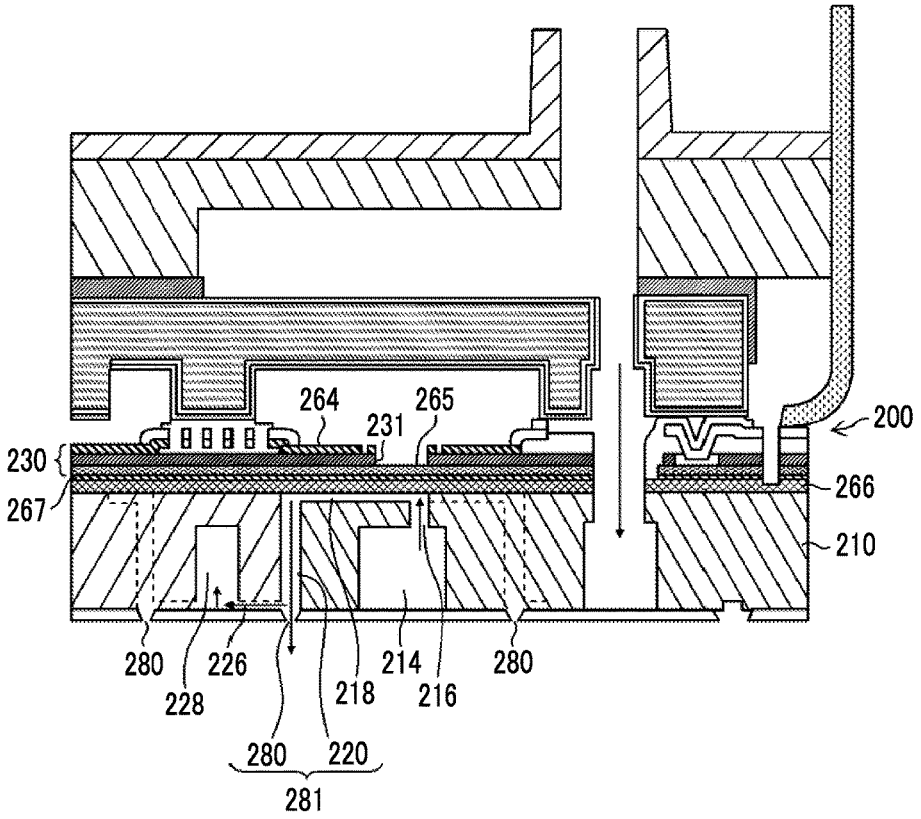
FIG. 5 is a cross-sectional view showing the internal structure of the head module.

FIG. 5 is a cross-sectional view showing the internal structure of the head module. The head module 200 includes an ink supply passage 214, individual supply passages 216, pressure chambers 218, nozzle communication passages 220, individual circulation flow passages 226, a common circulation flow passage 228, piezoelectric elements 230, and a vibrating plate 266.

The ink supply passage 214, the individual supply passages 216, the pressure chambers 218, the nozzle communication passages 220, the individual circulation flow passages 226, and the common circulation flow passage 228 are formed in a flow passage structure 210. The nozzle portion 281 may include the nozzle opening 280 and the nozzle communication passage 220.

The individual supply passage 216 is a flow passage that connects the pressure chamber 218 to the ink supply passage 214. The nozzle communication passage 220 is a flow passage that connects the pressure chamber 218 to the nozzle opening 280. The individual circulation flow passage 226 is a flow passage that connects the nozzle communication passage 220 to the common circulation flow passage 228.

The vibrating plate 266 is provided on the flow passage structure 210. The piezoelectric elements 230 are disposed on the vibrating plate 266 with an adhesive layer 267 therebetween. The piezoelectric element 230 has a structure in which a lower electrode 265, a piezoelectric layer 231, and an upper electrode 264 are laminated. The lower electrode 265 is called a common electrode, and the upper electrode 264 is called an individual electrode.

The upper electrode 264 is formed of an individual electrode that is patterned so as to correspond to the shape of each pressure chamber 218, and the piezoelectric element 230 is provided for each pressure chamber 218.

The ink supply passage 214 is connected to the ink supply chamber 232 described in FIG. 3. Ink is supplied to the pressure chamber 218 from the ink supply passage 214 through the individual supply passage 216. In a case in which a drive voltage is applied to the upper electrode 264 of the piezoelectric element 230 to be operated according to image data, the piezoelectric element 230 and the vibrating plate 266 are deformed and the volume of the pressure chamber 218 is changed.

The head module 200 can jet ink droplets from the nozzle openings 280 through the nozzle communication passages 220 due to a change in pressure that is caused by a change in the volume of the pressure chamber 218.

In a case in which the drive of the piezoelectric elements 230 corresponding to the respective nozzle openings 280 is controlled according to dot data that is generated from the image data, the head module 200 can jet ink droplets from the nozzle openings 280.

In a case in which jetting timings of ink droplets from the respective nozzle openings 280 shown in FIG. 4 are controlled according to the transport speed of a sheet 36 while the sheet 36 shown in FIG. 2 is transported in the sheet transport direction at a certain speed, a desired image is formed on the sheet 36.

Although not shown, the planar shape of the pressure chamber 218 provided so as to correspond to each nozzle opening 280 is a substantially square shape, an outlet, which is to be connected to the nozzle opening 280, is provided at one corner portion of both corner portions positioned on a diagonal line, and the individual supply passage 216, which is an inlet for ink to be supplied, is provided at the other corner portion thereof.

The shape of the pressure chamber is not limited to a square shape. The planar shape of the pressure chamber may be various shapes, such as a quadrangular shape (a rhombic shape, a rectangular shape, and the like), a pentagonal shape, a hexagonal shape, other polygonal shapes, a circular shape, an elliptical shape, and the like.

A circulation outlet (not shown) is formed at the nozzle portion 281 that includes the nozzle opening 280 and the nozzle communication passages 220. The nozzle portion 281 communicates with the individual circulation flow passage 226 through the circulation outlet. Ink, which is not used for jetting, of ink of the nozzle portion 281 is collected to the common circulation flow passage 228 through the individual circulation flow passage 226.

The common circulation flow passage 228 is connected to the ink circulation chamber 236 described in FIG. 4. Since ink is normally collected to the common circulation flow passage 228 through the individual circulation flow passage 226, the thickening of ink of the nozzle portion during a period in which ink is not jetted is prevented.

The piezoelectric element 230 having a structure individually separated so as to correspond to each nozzle portion 281 is exemplified in FIG. 5 as an example of a piezoelectric element. Of course, a structure in which the piezoelectric layer 231 is integrally formed so as to correspond to the plurality of nozzle portions 281, the individual electrode is formed so as to correspond to each nozzle portion 281, and an active region is formed for each nozzle portion 281 may be applied.

The head module 200 may include a heater, which is provided in the pressure chamber 218, as a pressure generating element instead of the piezoelectric element. A thermal system, which supplies a drive voltage to the heater to allow the heater to generate heat and uses a film boiling phenomenon to jet ink present in the pressure chamber 218 from the nozzle opening 280, may be applied to the head module 200.

<Description of Ink Supply Section>

Figure 6:
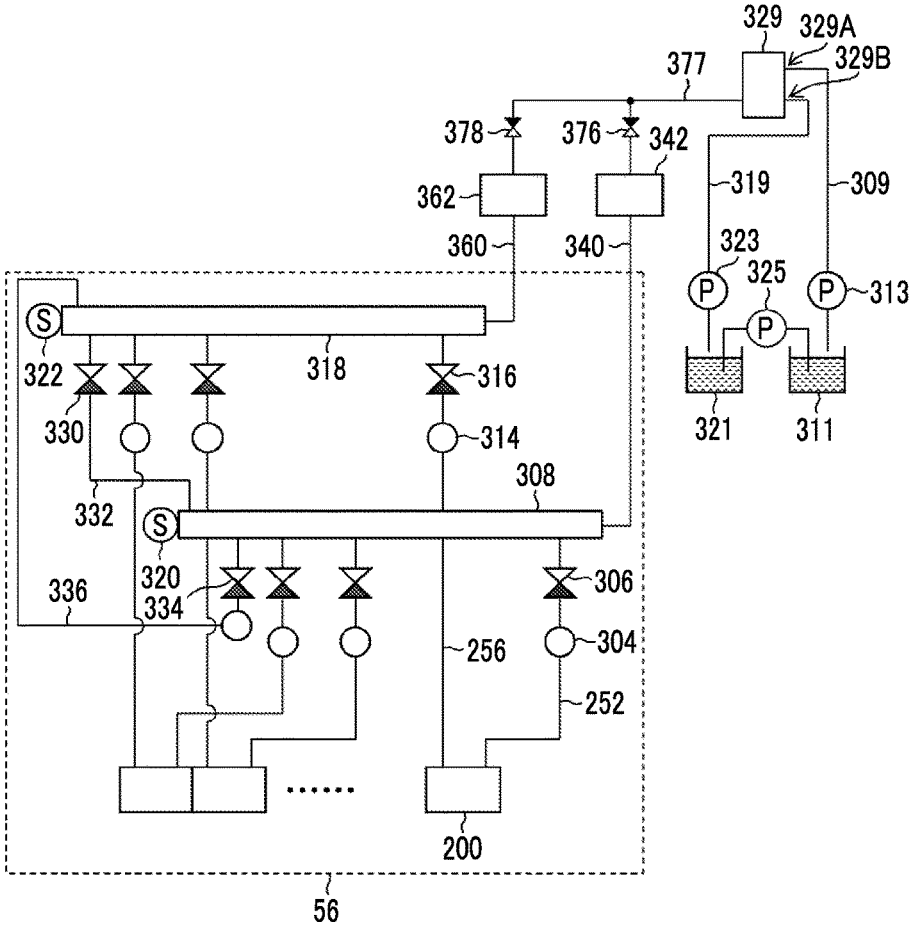
FIG. 6 is a block diagram showing the configuration of an internal flow passage of the liquid jet head and the configuration of an ink supply system.

FIG. 6 is a block diagram showing the configuration of an internal flow passage of the liquid jet head and the configuration of an ink supply system. An ink supply section 127 shown in FIG. 8 includes the internal flow passage of the liquid jet head and the ink supply system shown in FIG. 6.

As shown in FIG. 6, the liquid jet head 56 includes the plurality of head modules 200. Some head modules 200 of the plurality of head modules 200 are not shown in FIG. 6.

The supply-side individual flow passage 252 of each head module 200 is connected to a supply-side manifold 308 through a supply-side damper 304 and a supply-side valve 306. Likewise, the collection-side individual flow passage 256 of each head module 200 is connected to a collection-side manifold 318 through a collection-side damper 314 and a collection-side valve 316.

For the convenience of illustration, in FIG. 6, reference numerals are given to only one of the supply-side individual flow passages 252, only one of the supply-side dampers 304, only one of the supply-side valves 306, the supply-side manifold 308, only one of the collection-side individual flow passages 256, only one of the collection-side dampers 314, only one of the collection-side valves 316, and the collection-side manifold 318.

The supply-side manifold 308 is a flow passage structure in which ink to be supplied to the head modules 200 is temporarily stored and which is common to the plurality of head modules 200 in the liquid jet head 56.

The collection-side manifold 318 is a flow passage structure in which ink to be collected from the head modules 200 is temporarily stored and which is common to the plurality of head modules 200 in the liquid jet head 56.

A supply-side pressure sensor 320 is mounted on the supply-side manifold 308 as means for measuring the pressure of liquid that is stored in the supply-side manifold 308. A collection-side pressure sensor 322 is mounted on the collection-side manifold 318 as means for measuring the pressure of liquid that is stored in the collection-side manifold 318.

The collection-side manifold 318 is connected to the supply-side manifold 308 through a first bypass flow passage valve 330 and a first bypass flow passage 332. The supply-side manifold 308 is connected to the collection-side manifold 318 through a second bypass flow passage valve 334 and a second bypass flow passage 336.

The supply-side manifold 308 is connected to a supply back pressure tank 342 through a supply-side flow passage 340. The detailed structure of the supply back pressure tank 342 is not shown. Examples of structure of the supply back pressure tank 342 include a sealed structure of which an internal space is partitioned into a gas chamber and a liquid chamber by an elastic film.

The gas chamber of the supply back pressure tank 342 may be connected to an air tank through a valve and a flow passage. A flow passage, on which a valve is mounted and which is opened to the atmosphere, may be connected to the air tank. The air tank can be opened to the atmosphere in a case in which a valve opened to the atmosphere is opened.

The collection-side manifold 318 is connected to a collection back pressure tank 362 through a collection-side flow passage 360. The detailed structure of the collection back pressure tank 362 is not shown. The same structure as the supply back pressure tank 342 can be applied to the collection back pressure tank 362.

The supply back pressure tank 342 and the collection back pressure tank 362 can function as dampers for flow passages that communicate with the supply back pressure tank 342 and the collection back pressure tank 362.

The supply back pressure tank 342 is connected to a common flow passage 377 through a supply flow passage valve 376. The collection back pressure tank 362 is connected to the common flow passage 377 through a collection flow passage valve 378.

The common flow passage 377 is connected to a direction-switching valve 329. A second supply flow passage 309 is connected to a first output port 329A of the direction-switching valve 329. A second collection flow passage 319 is connected to a second output port 329B of the direction-switching valve 329.

The second supply flow passage 309 is connected to a supply tank 311 through a supply pump 313. Further, the second collection flow passage 319 is connected to a collection tank 321 through a collection pump 323. The supply tank 311 and the collection tank 321 communicate with each other through a pump 325.

The direction-switching valve 329 is switched to connect the second supply flow passage 309 to the common flow passage 377 or to connect the second collection flow passage 319 to the common flow passage 377. The supply of ink to the liquid jet head 56 from the supply tank 311 and the collection of ink to the collection tank 321 from the liquid jet head 56 can be switched by the switching of the direction-switching valve 329.

Filters for capturing foreign materials, deaerators for removing air bubbles present in ink, check valves for preventing the back flow of ink, and the like are appropriately disposed in the ink supply system shown in FIG. 6.

[Description of Head Moving Unit]

Figure 7:
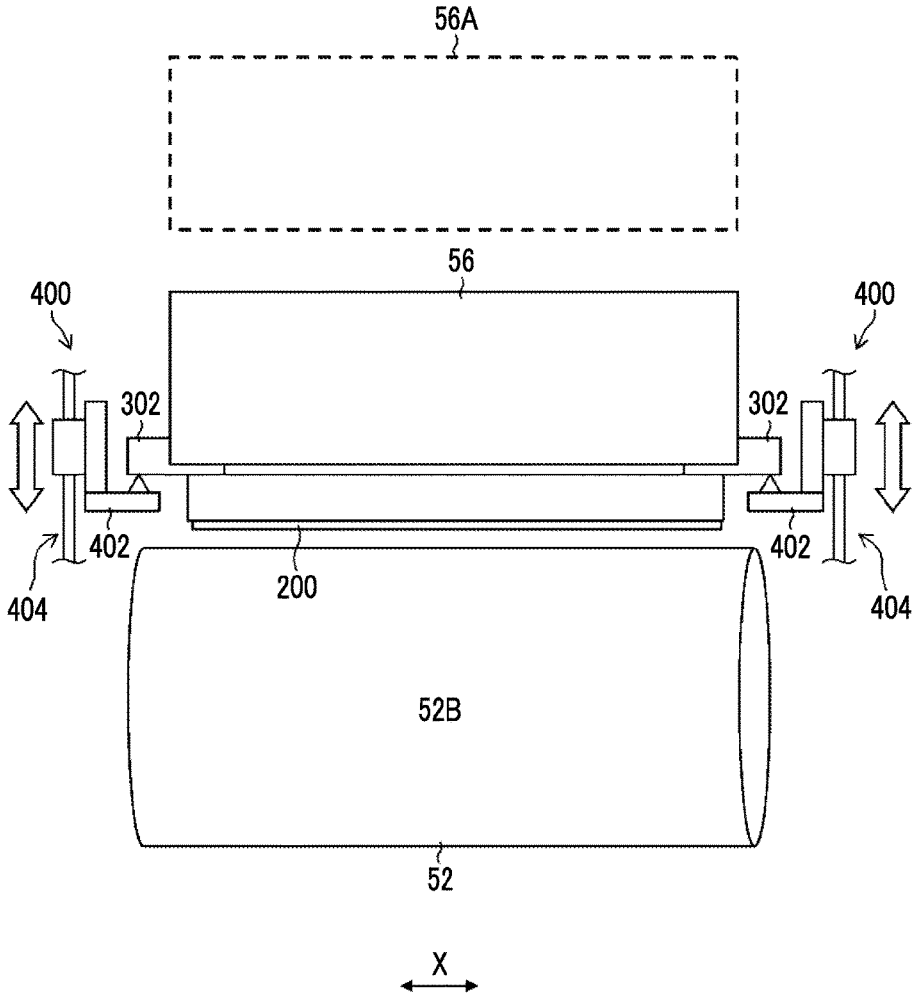
FIG. 7 is a schematic diagram schematically showing the schematic configuration of head moving units.

FIG. 7 is a schematic diagram schematically showing the schematic configuration of the head moving units. Only any one of the liquid jet heads 56C, 56M, 56Y, and 56K shown in FIG. 1 is denoted in FIG. 7 by reference numeral 56.

The head moving units 400 shown in FIG. 7 move the liquid jet head 56 between a drawing position and a retreat position by moving the liquid jet head 56 in a vertical direction. In FIG. 7, the moving direction of the liquid jet head 56 is indicated by an arrow line.

The drawing position is the position of the liquid jet head 56 in a case in which the liquid jet head 56 jets liquid to the sheet 36 transported by the drawing drum 52. A distance between the liquid jet head 56 that is disposed at the drawing position and the sheet 36 that is supported by the drawing drum 52 is 1 mm or less. The drawing position is one aspect of a liquid jet position.

The retreat position is a position to which the liquid jet head 56 is to be moved in a case in which the floating of a sheet 36 is detected. The retreat position is the position of the liquid jet head 56 where the sheet 36 and the liquid jetting surface 277 of the liquid jet head 56 are not in contact with each other even in a case in which the floating of a sheet 36 occurs. A broken line denoted in FIG. 7 by reference numeral 56A shows a liquid jet head that is moved to the retreat position.

Further, the retreat position is a position from which the liquid jet head 56 can return to the drawing position in a short period of time in a case in which the floating of a sheet 36 is eliminated.

The head moving units 400 are disposed outside both ends of the liquid jet head 56 in a longitudinal direction of the liquid jet head 56. The longitudinal direction of the liquid jet head 56 is the width direction of a sheet 36 that is denoted by reference letter X, and is a direction orthogonal to the sheet transport direction.

The head moving unit 400 includes a head support member 402 that supports a raising/lowering support member 302 mounted on the liquid jet head 56, and an actuator 404 that raises and lowers the head support member 402 in the vertical direction.

The actuator 404 includes a raising/lowering mechanism and a drive source for the raising/lowering mechanism. A ball screw or the like can be applied as the raising/lowering mechanism. A rotary motor can be applied as the drive source. A linear motor in which a raising/lowering mechanism and a drive source are integrated with each other may be applied.

The head moving units 400, which raise and lower the liquid jet head 56 in the vertical direction, are shown in this embodiment, but the head moving units 400 may move the liquid jet head 56 in an oblique direction having a vertical component. For example, the head moving units 400 may move the liquid jet head 56 in a normal direction of the outer peripheral surface 52B of the drawing drum 52.

The head moving units 400 shown in FIG. 7 may be adapted to collectively raise and lower the four liquid jet heads 56C, 56M, 56Y, and 56K in a case in which the four liquid jet heads 56C, 56M, 56Y, and 56K shown in FIG. 1 are to be raised and lowered.

The head moving units 400 shown in FIG. 7 may be adapted to individually raise and lower the four liquid jet heads 56C, 56M, 56Y, and 56K shown in FIG. 1.

[Description of Control System]

FIG. 8 is a block diagram showing the schematic configuration of a control system. As shown in FIG. 8, the ink jet recording apparatus 10 includes a system controller 100. Although not shown, the system controller 100 may include a CPU, a ROM, and a RAM.

CPU is an abbreviation for Central Processing Unit. ROM is an abbreviation for Read Only Memory. RAM is an abbreviation for Random Access Memory.

The system controller 100 functions as a total control section that generally controls the respective parts of the ink jet recording apparatus 10. Further, the system controller 100 functions as a calculation section that performs various kinds of calculation processing. Furthermore, the system controller 100 functions as a memory controller that controls the reading of data of a memory and the writing of data.

The ink jet recording apparatus 10 shown in FIG. 8 includes a communication unit 102 and an image memory 104. The communication unit 102 includes a communication interface (not shown). The communication unit 102 can transmit and receive data to and from a host computer 103 connected to the communication interface.

The image memory 104 functions as a temporary storage section for various kinds of data including image data. Data is read from and written in the image memory 104 through the system controller 100. Image data, which is taken from the host computer 103 through the communication unit 102, is temporarily stored in the image memory 104.

The ink jet recording apparatus 10 shown in FIG. 8 includes a sheet feed control unit 110, a transport control unit 112, a treatment liquid-application control unit 116, a treatment liquid-drying processing control unit 117, a drawing control unit 118, a head movement control unit 120, an ink-drying processing control unit 122, and a sheet discharge control unit 124.

The sheet feed control unit 110 allows the sheet feed unit 12 to be operated according to a command sent from the system controller 100. The sheet feed control unit 110 controls an operation for starting feeding the sheet 36, an operation for stopping feeding the sheet 36, and the like. The sheet feed control unit 110 is one aspect of a medium feed control unit.

The transport control unit 112 controls the operation of a transport unit 114 for the sheet 36 of the ink jet recording apparatus 10. The transport unit 114 shown in FIG. 8 includes the treatment liquid drum 42, the treatment liquid-drying processing drum 46, the drawing drum 52, and the sheet transport member 22 shown in FIG. 1.

The treatment liquid-application control unit 116 allows the treatment liquid-application section 14 to be operated according to a command sent from the system controller 100. The treatment liquid-application control unit 116 controls the amount of treatment liquid to be applied, a treatment liquid-application timing, and the like.

The treatment liquid-drying processing control unit 117 allows the treatment liquid-drying processing section 16 to be operated according to a command sent from the system controller 100. The treatment liquid-drying processing control unit 117 controls drying temperature, the flow rate of dry gas, the injection timing of dry gas, and the like.

The treatment liquid-drying processing control unit 117 controls the switching of the treatment liquid-drying processing-performing state and the treatment liquid-drying processing-suppression state of the treatment liquid-drying processing device 50 of the treatment liquid-drying processing section 16 shown in FIG. 1. The treatment liquid-drying processing control unit 117 is not stopped in the treatment liquid-drying processing-suppression state of the treatment liquid-drying processing device 50 of the treatment liquid-drying processing section 16.

The drawing control unit 118 controls the operation of the drawing unit 18 according to a command sent from the system controller 100. That is, the drawing control unit 118 controls the jet of ink from the liquid jet heads 56C, 56M, 56Y, and 56K shown in FIG. 1.

The drawing control unit 118 includes an image processing section (not shown). The image processing section generates dot data from input image data. The image processing section includes a color separation processing section, a color conversion processing section, a correction processing section, and a halftoning section (not shown).

In the color separation processing section, color separation processing is performed on the input image data. For example, in a case in which the input image data is represented in RGB, the input image data is separated into data of the respective colors of R, G, and B. Here, R represents red. G represents green. B represents blue.

In the color conversion processing section, image data, which are separated into the data of R, G, and B and correspond to the respective colors, are converted into C, M, Y, and K corresponding to the colors of inks. Here, C represents cyan. M represents magenta. Y represents yellow. K represents black.

In the correction processing section, correction processing is performed on the image data that are converted into C, M, Y, and K and correspond to the respective colors. Examples of the correction processing include gamma correction processing, processing for correcting density unevenness, processing for correcting an abnormal recording element, and the like.

In the halftoning section, image data represented by multiple numbers of gradations in the range of, for example, 0 to 255 are converted into dot data represented by a binary value or a multi-level value that is a ternary value or more and is smaller than the number of gradations of the input image data.

In the halftoning section, a predetermined halftoning rule is applied. Examples of the halftoning rule include a dither method, an error diffusion method, and the like. The halftoning rule may be changed according to image recording conditions, the contents of image data, or the like.

The drawing control unit 118 includes a waveform generation unit, a waveform storage unit, and a drive circuit (not shown). The waveform generation unit generates a waveform of a drive voltage. The waveform of the drive voltage is stored in the waveform storage unit. The drive circuit generates a drive voltage having a drive waveform corresponding to dot data. The drive circuit supplies the drive voltage to the liquid jet heads 56C, 56M, 56Y, and 56K shown in FIG. 1.

That is, a jetting timing and the amount of ink to be jetted at the position of each pixel are determined on the basis of dot data generated through the processing that is performed by the image processing section, a drive voltage corresponding to the jetting timing and the amount of ink to be jetted at the position of each pixel and a control signal determining the jetting timing at each pixel are generated, this drive voltage is supplied to the liquid jet heads, and dots are formed by the ink jetted from the liquid jet heads. The drawing control unit is one aspect of a jetting control unit.

The ink-drying processing control unit 122 allows the ink-drying processing section 20 to be operated according to a command sent from the system controller 100. The ink-drying processing control unit 122 controls the temperature of dry gas, the flow rate of dry gas, the injection timing of dry gas, or the like. The ink-drying processing control unit 122 is one aspect of a liquid-drying processing control unit.

The ink-drying processing control unit 122 controls the switching of the ink-drying processing-performing state and the ink-drying processing-suppression state of the drying processing device 21 of the ink-drying processing section 20 shown in FIG. 1. The ink-drying processing control unit 122 is not stopped in the ink-drying processing-suppression state of the drying processing device 21 of the ink-drying processing section 20.

The sheet discharge control unit 124 allows the sheet discharge unit 24 to be operated according to a command sent from the system controller 100. The sheet discharge control unit 124 controls the sorting of a sheet 36 that is subjected to normal drawing and a sheet 36 that is determined as a waste sheet.

The ink jet recording apparatus 10 shown in FIG. 8 includes an ink supply control unit 126. The ink supply control unit 126 controls the operation of the ink supply section 127, which includes the internal flow passage of the liquid jet head and the ink supply system shown in FIG. 6, according to a command sent from the system controller 100.

That is, the ink supply control unit 126 functions as a pump control section that controls the operation of a pump, such as the supply pump 313 shown in FIG. 6. Examples of the control of the operation of a pump include the off-on control of a pump, the control of the flow rate of a pump, and the like.

Further, the ink supply control unit 126 shown in FIG. 8 functions as a valve control section that controls the operation of a valve, such as the supply-side valve 306 shown in FIG. 6. Examples of the control of the operation of a valve include the off-on control of a valve.

The ink jet recording apparatus 10 shown in FIG. 8 includes an operation unit 130 and a display section 132.

The operation unit 130 includes operation members, such as an operation button, a keyboard, or a touch panel. The operation unit 130 may include plural kinds of operation members. The operation members are not shown.

Information, which is input through the operation unit 130, is sent to the system controller 100. The system controller 100 performs various kinds of processing according to the information that is sent from the operation unit 130.

The display section 132 includes a display device, such as a liquid crystal panel, and a display driver. The display device and the display driver are not shown. The display section 132 allows the display device to display various kinds of information, such as various kinds of configuration information of the apparatus or information on abnormalities of the apparatus, according to a command sent from the system controller 100.

The ink jet recording apparatus 10 shown in FIG. 8 includes a parameter storage unit 134 and a program storage unit 136.

Various parameters, which are used in the ink jet recording apparatus 10, are stored in the parameter storage unit 134. Various parameters, which are stored in the parameter storage unit 134, are read through the system controller 100 and are set in respective parts of the apparatus.

Various programs, which are used in the respective parts of the ink jet recording apparatus 10, are stored in the program storage unit 136. Various programs, which are stored in the program storage unit 136, are read through the system controller 100 and are executed in respective parts of the apparatus.

The ink jet recording apparatus 10 shown in FIG. 8 includes a sheet floating detection unit 140. The sheet floating detection unit 140 includes the sheet floating sensor 55 shown in FIG. 1. The sheet floating detection unit 140 determines whether or not the floating of a sheet 36 having passed through a detection region of the sheet floating sensor 55 occurs on the basis of an output signal of the sheet floating sensor 55.

The sheet floating detection unit 140 sends the detection information on a sheet 36, of which the floating occurs, to the system controller 100. In a case in which the system controller 100 acquires the detection information on a sheet 36 of which the floating occurs, the system controller 100 sends commands, which allow the liquid jet heads 56M, 56Y, and 56K shown in FIG. 1 to retreat to the retreat positions, to the head movement control unit 120. The sheet floating detection unit 140 is one aspect of a medium floating detection unit.

Further, in a case in which the system controller 100 acquires information on a sheet 36 of which the floating occurs, the system controller 100 sends commands, which change processing, to the treatment liquid-application control unit 116, the treatment liquid-drying processing control unit 117, the drawing control unit 118, and the ink-drying processing control unit 122. The details of the change of processing will be described later.

The ink jet recording apparatus 10 shown in FIG. 8 includes a pressure detection unit 142.

The pressure detection unit 142 includes the supply-side pressure sensor 320 and the collection-side pressure sensor 322 shown in FIG. 6. The pressure detection unit 142 shown in FIG. 8 sends pressure information, which represents the pressure of the supply-side manifold 308 shown in FIG. 6, and pressure information, which represents the pressure of the collection-side manifold 318, to the system controller 100 shown in FIG. 8. The pressure detection unit 142 is one aspect of a jetting state detection unit.

The ink jet recording apparatus 10 shown in FIG. 8 includes a waste sheet-number setting unit 144. In a case in which a sheet 36 of which the floating occurs is detected by the sheet floating detection unit 140, the waste sheet-number setting unit 144 derives the number of sheets 36 as waste sheets while regarding the sheet 36 of which the floating occurs as a first waste sheet and sets the derived number of waste sheets.

For example, the number of sheets 36 passing through the drawing regions of the liquid jet heads 56C, 56M, 56Y, and 56K in a head retreat period, which is a period between a timing when the liquid jet heads 56C, 56M, 56Y, and 56K start to retreat from the drawing positions and a timing when the liquid jet heads 56C, 56M, 56Y, and 56K have completely returned to the drawing positions and is a period in which the liquid jet heads 56C, 56M, 56Y, and 56K are retreating from the drawing positions, can be calculated from the feed timing of the sheet 36 and the transport speed of the sheet 36.

The drawing regions of the liquid jet heads 56C, 56M, 56Y, and 56K are regions positioned on the transport path of the sheet 36, and mean regions in which the liquid jet heads 56C, 56M, 56Y, and 56K jet liquid.

The number of waste sheets, which is set, is displayed on the display section 132 and can be notified to an operator. In a case in which the operator grasps the number of waste sheets displayed on the display section 132, the operator can add the number of waste sheets to the number of sheets subjected to drawing.

A sensor 146 shown in FIG. 8 includes various sensors, such as the sheet feed sensor 32 shown in FIG. 1. For example, the system controller 100 acquires sheet feed information that is sent from the sheet feed sensor 32 and represents the feed of a sheet 36. The sheet feed information acquired by the system controller 100 can be used for the control of the transport of the sheet 36, and the like.

[Description of Method of Coping with Floating of Sheet]

First Embodiment

Next, a method of coping with the floating of a sheet according to a first embodiment, which is applied to the above-mentioned ink jet recording apparatus 10, will be described. The method of coping with the floating of a sheet corresponds to a method of coping with the floating of a medium. The method of coping with the floating of a sheet to be described below can be applied to a case in which drawing is successively performed on a plurality of sheets 36.

Figure 9:
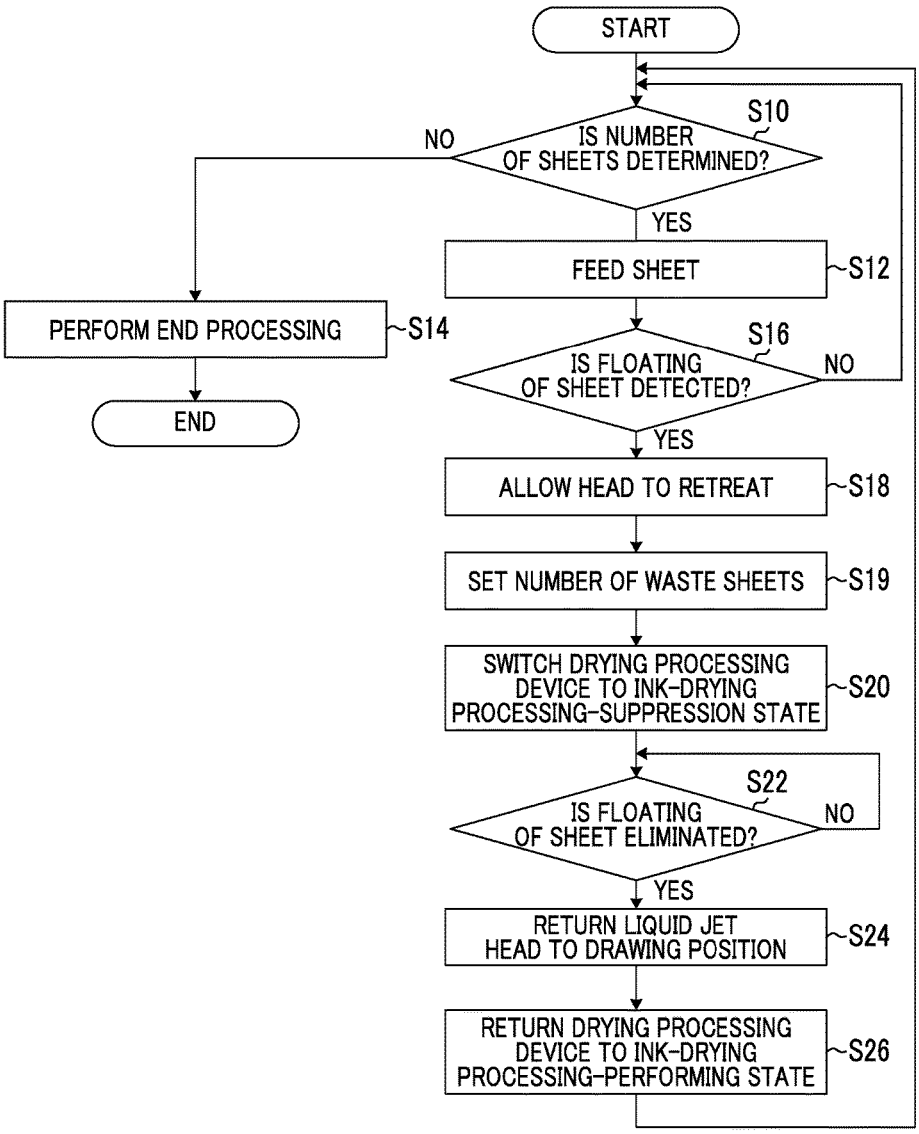
FIG. 9 is a flowchart showing a procedure of a method of coping with the floating of a sheet according to a first embodiment.

FIG. 9 is a flowchart showing a procedure of drawing to which the method of coping with the floating of a sheet according to the first embodiment is applied.

After image data and drawing, which includes the number of sheets to be subjected to drawing, are set the start of drawing is determined, it is determined in a sheet-number determination step S10 whether or not a preset number of sheets 36 are subjected to drawing. If a preset number of sheets 36 are not subjected to drawing, the determination of the sheet-number determination step S10 is determined as YES. If the determination of the sheet-number determination step S10 is determined as YES, processing proceeds to a sheet feed step S12.

On the other hand, if a preset number of sheets 36 are subjected to drawing, the determination of the sheet-number determination step S10 is determined as NO. If the determination of the sheet-number determination step S10 is determined as NO, processing proceeds to an end processing step S14. Then, drawing ends.

In the sheet feed step S12, sheets 36 are fed from the sheet feed unit 12 shown in FIG. 1 at predetermined sheet feed timings. The predetermined sheet feed timings may be regular intervals and may be irregular intervals.

The feed timings of the sheets 36, which are fed in the sheet feed step S12, are detected by the sheet feed sensor 32 shown in FIG. 1. Further, the number of the sheets 36 fed in the sheet feed step S12 is measured by a counter (not shown).

Further, the positions of the sheets 36 fed in the sheet feed step S12 can be found out by the sheet feed control unit 110 shown in FIG. 8.

After the sheets are fed in the sheet feed step S12, processing proceeds to a sheet floating detection step S16. The sheet feed step S12 is one aspect of a medium feeding step.

In the sheet floating detection step S16, the sheet floating sensor 55 shown in FIG. 1 detects whether or not the floating of a sheet 36 occurs. The sheet floating detection step S16 shown in FIG. 9 is performed on all the sheets 36 passing through the detection region of the sheet floating sensor 55 shown in FIG. 1.

A criterion, which is used to determine whether or not the floating of a sheet occurs in the sheet floating detection step S16 shown in FIG. 9, is determined from a condition where the sheet 36 is not in contact with the liquid jetting surface 277 shown in FIG. 4 in a period in which the sheet 36 passes through the drawing regions of the liquid jet heads 56C, 56M, 56Y, and 56K disposed at the drawing positions.

A period in which the sheet 36 passes through the drawing region can be set as a period between a timing when the front end of the sheet 36 enters the drawing region and a timing when the rear end of the sheet 36 has gotten out of the drawing region. The front end of the sheet 36 and the rear end of the sheet 36 may be any position of the sheet 36.

It is preferable that the criterion, which is used to determine whether or not the floating of a sheet occurs, is determined according to the type of each sheet 36. The thickness of the sheet 36, the material of the sheet 36, or the like can be applied as the type of the sheet 36. Further, it is preferable that a criterion used to determine the floating of a sheet is set in units of a job for forming an image.

If the floating of a sheet is not detected in the sheet floating detection step S16 shown in FIG. 9, the determination of the sheet floating detection step S16 is determined as NO. If the determination of the sheet floating detection step S16 is determined as NO, processing proceeds to the sheet-number determination step S10. That is, the sheet 36 of which the floating is not detected in the sheet floating detection step S16 is sent to the sheet discharge unit 24 shown in FIG. 1 through a drawing step (not shown) and an ink-drying processing step (not shown). The drawing step is one aspect of a liquid jetting step. The ink-drying processing step is one aspect of a liquid-drying processing step.

On the other hand, if the floating of a sheet is detected in the sheet floating detection step S16 shown in FIG. 9, the determination of the sheet floating detection step S16 is determined as YES. If the determination of the sheet floating detection step S16 is determined as YES, coping with the floating of a sheet is performed. The coping with the floating of a sheet includes the retreat of the heads in a head retreat step S18. The heads mentioned here are the liquid jet heads 56C, 56M, 56Y, and 56K shown in FIG. 1.

In the head retreat step S18, the head moving units 400 shown in FIG. 7 are operated to move the liquid jet heads 56C, 56M, 56Y, and 56K shown in FIG. 1 to the retreat positions before the sheet 36 of which the floating is detected reaches the drawing regions of the liquid jet heads 56C, 56M, 56Y, and 56K shown in FIG. 1.

Further, if the floating of a sheet is detected in the sheet floating detection step S16, the number of waste sheets is set in a waste sheet-number setting step S19. The number of waste sheets is the number of sheets 36 passing through the drawing regions of the liquid jet heads 56M, 56Y, and 56K in a period that is obtained by adding up a period in which the liquid jet heads 56C, 56M, 56Y, and 56K shown in FIG. 1 are moved to the retreat positions from the drawing positions, a period in which the retreat of the liquid jet heads 56C, 56M, 56Y, and 56K to the retreat positions is continued, a period in which the liquid jet heads 56C, 56M, 56Y, and 56K are moved to the drawing positions from the retreat positions, and a period in which the drawing of the liquid jet heads 56C, 56M, 56Y, and 56K is prepared.

After the number of waste sheets is set in the waste sheet-number setting step S19 shown in FIG. 9, processing proceeds to an ink-drying processing-suppression switching step S20. In the ink-drying processing-suppression switching step S20, the drying processing device 21 of the ink-drying processing section 20 shown in FIG. 1 is switched to the ink-drying processing-suppression state. Then, the sheet 36 of which the floating is detected in the sheet floating detection step S16 shown in FIG. 9 is regarded as a first sheet, and the ink-drying processing-suppression state is maintained until a timing when a sheet 36 corresponding to the order of the number of waste sheets, which is set in the waste sheet-number setting step S19, from the first sheet 36 gets out of the drying processing region of the drying processing device 21.

The timing when the sheet 36 gets out of the drying processing region of the drying processing device 21 may be a timing when the front end of the sheet 36 gets out of the drying processing region of the drying processing device 21. Further, the timing when the sheet 36 gets out of the drying processing region of the drying processing device 21 may be a timing when the rear end of the sheet 36 gets out of the drying processing region of the drying processing device 21. The front end of the sheet 36 and the rear end of the sheet 36 may be any position of the sheet 36.

The orders of the head retreat step S18 and the waste sheet-number setting step S19 shown in FIG. 9 may be exchanged with each other. The period of the head retreat step S18 and the period of the waste sheet-number setting step S19 may overlap each other. The head retreat step S18 is a component of a head moving step.

In the method of coping with the floating of a sheet described in this embodiment, a sheet continues to be fed if the floating of the sheet is detected in the sheet floating detection step S16. That is, even though the floating of a sheet is detected in the sheet floating detection step S16, the sheet feed step S12 is not interrupted or stopped.

In a case in which the liquid jet heads 56C, 56M, 56Y, and 56K shown in FIG. 1 retreat to the retreat positions in the head retreat step S18 shown in FIG. 9 and the drying processing device 21 of the ink-drying processing section 20 shown in FIG. 1 is switched to the ink-drying processing-suppression state in the ink-drying processing-suppression switching step S20, it is determined in a sheet floating-elimination determination step S22 whether or not the floating of a sheet 36 is eliminated.

If sheets 36 of which the floating is detected are continuous to each other among sheets 36 that successively pass through the detection region of the sheet floating sensor 55 shown in FIG. 1, it can be determined in the sheet floating-elimination determination step S22 that the floating is not eliminated.

A detection signal of the sheet floating sensor 55 shown in FIG. 1 is used for the detection of the elimination of the floating of a sheet in the sheet floating-elimination determination step S22. That is, in a case in which a detection signal, which represents the non-detection of the floating of a sheet, is output from the sheet floating sensor 55, it can be determined that the floating of a sheet is eliminated.

If it is determined in the sheet floating-elimination determination step S22 that the floating of a sheet 36 is not eliminated, the determination of the sheet floating-elimination determination step S22 is determined as NO. If the determination of the sheet floating-elimination determination step S22 is determined as NO, the determination of the elimination of the floating of a sheet is continued in the sheet floating-elimination determination step S22.

That is, it is determined in the sheet floating-elimination determination step S22 whether or not the floating of all the sheets 36 passing through the detection region of the sheet floating sensor 55 shown in FIG. 1 occurs is determined.

On the other hand, if it is determined in the sheet floating-elimination determination step S22 that the floating of a sheet 36 is eliminated, the determination of the sheet floating-elimination determination step S22 is determined as YES. If the determination of the sheet floating-elimination determination step S22 is determined as YES, processing proceeds to a head position-return step S24.

In the head position-return step S24, the liquid jet heads 56C, 56M, 56Y, and 56K shown in FIG. 1 are moved to the drawing positions from the retreat positions. The head position-return step S24 is a component of the head moving step.

Further, if it is determined in the sheet floating-elimination determination step S22 shown in FIG. 9 that the floating of a sheet 36 is eliminated, an ink-drying processing-performing state-return step S26 is performed. In the ink-drying processing-performing state-return step S26, the drying processing device 21 of the ink-drying processing section 20 is switched to the ink-drying processing-performing state from the ink-drying processing-suppression state after the elapse of a period in which all waste sheets pass through the processing region of the ink-drying processing section 20 shown in FIG. 1.

A timing when the drying processing device 21 is switched to the ink-drying processing-performing state from the ink-drying processing-suppression state may be determined in consideration of a processing period in a case in which the drying processing device 21 is switched to the ink-drying processing-performing state from the ink-drying processing-suppression state.

In the head position-return step S24 shown in FIG. 9, the liquid jet heads 56C, 56M, 56Y, and 56K shown in FIG. 1 return to the drawing positions. Then, in a case in which the drying processing device 21 of the ink-drying processing section 20 shown in FIG. 1 is switched to the ink-drying processing-performing state in the ink-drying processing-performing state-return step S26, processing proceeds to the sheet-number determination step S10.

Further, drawing to which the method of coping with the floating of a sheet is applied is performed until a preset number of sheets 36 are subjected to drawing.

The number of waste sheets, which is set in the waste sheet-number setting step S19 shown in FIG. 9, can be displayed on the display section 132 shown in FIG. 8. Furthermore, the number of sheets 36, which are not subjected to drawing, is measured, and the measured number of sheets 36 may be displayed on the display section 132 shown in FIG. 8 as the number of waste sheets.

Whether or not a sheet is a sheet not actually subjected to drawing can be determined using the imaging result of a sheet 36 that is obtained from the in-line sensor 58 shown in FIG. 1. An operator can set the number of waste sheets, which is displayed on the display section 132 shown in FIG. 8, as a shortfall in the number of sheets subjected to drawing. The ink jet recording apparatus 10 shown in FIG. 1 can perform drawing on sheets 36 of which the number corresponds to a shortfall in the number of sheets caused by the generation of waste sheets.

Effects of First Embodiment

In a case in which the floating of a sheet is detected in the method of coping with the floating of a sheet that is adapted as described above, the sheet continues to be fed and the liquid jet heads are moved to the retreat positions. The ink-drying processing section is switched to the ink-drying processing-suppression state from the ink-drying processing-performing state. After that, in a case in which the floating of a sheet is eliminated, the liquid jet heads return to the drawing positions. Moreover, the ink-drying processing section returns to the ink-drying processing-performing state from the ink-drying processing-suppression state.

Accordingly, since the liquid jet heads retreat to the retreat positions in a case in which the floating of a sheet is detected, a collision between the sheet and the liquid jet heads is avoided. Further, since a sheet continues to be fed in a case in which the floating of the sheet is detected, a period between the elimination of the floating of the sheet and a time when drawing can be resumed can be made shorter than that in a case in which the feed of a sheet is interrupted or stopped at the time of detection of the floating of the sheet. As a result, the deterioration of production efficiency can be suppressed.

Furthermore, since the ink-drying processing section is switched to the ink-drying processing-suppression state in which the intensity of drying processing of the ink-drying processing section is suppressed in a case in which the floating of a sheet is detected, a period between the elimination of the floating of the sheet and the resumption of the processing of the ink-drying processing section can be made shorter than that in a case in which the ink-drying processing section is completely stopped at the time of detection of the floating of the sheet. As a result, the deterioration of production efficiency can be suppressed.

A case in which the ink-drying processing section is completely stopped, which is mentioned here, is a case in which the entire system of the ink-drying processing section including the processing of the control system is stopped by emergency stop or the like. In a case in which the ink-drying processing section is completely stopped, processing requiring a long period, such as initialization processing, is required at the time of the restart of the ink-drying processing section.

Second Embodiment

Next, a method of coping with the floating of a sheet according to a second embodiment will be described. The same components of the method of coping with the floating of a sheet according to the second embodiment to be described below as the components of the method of coping with the floating of a sheet according to the first embodiment will be denoted by the same reference numerals as those of the first embodiment, and the description thereof will be appropriately omitted.

Figure 10:
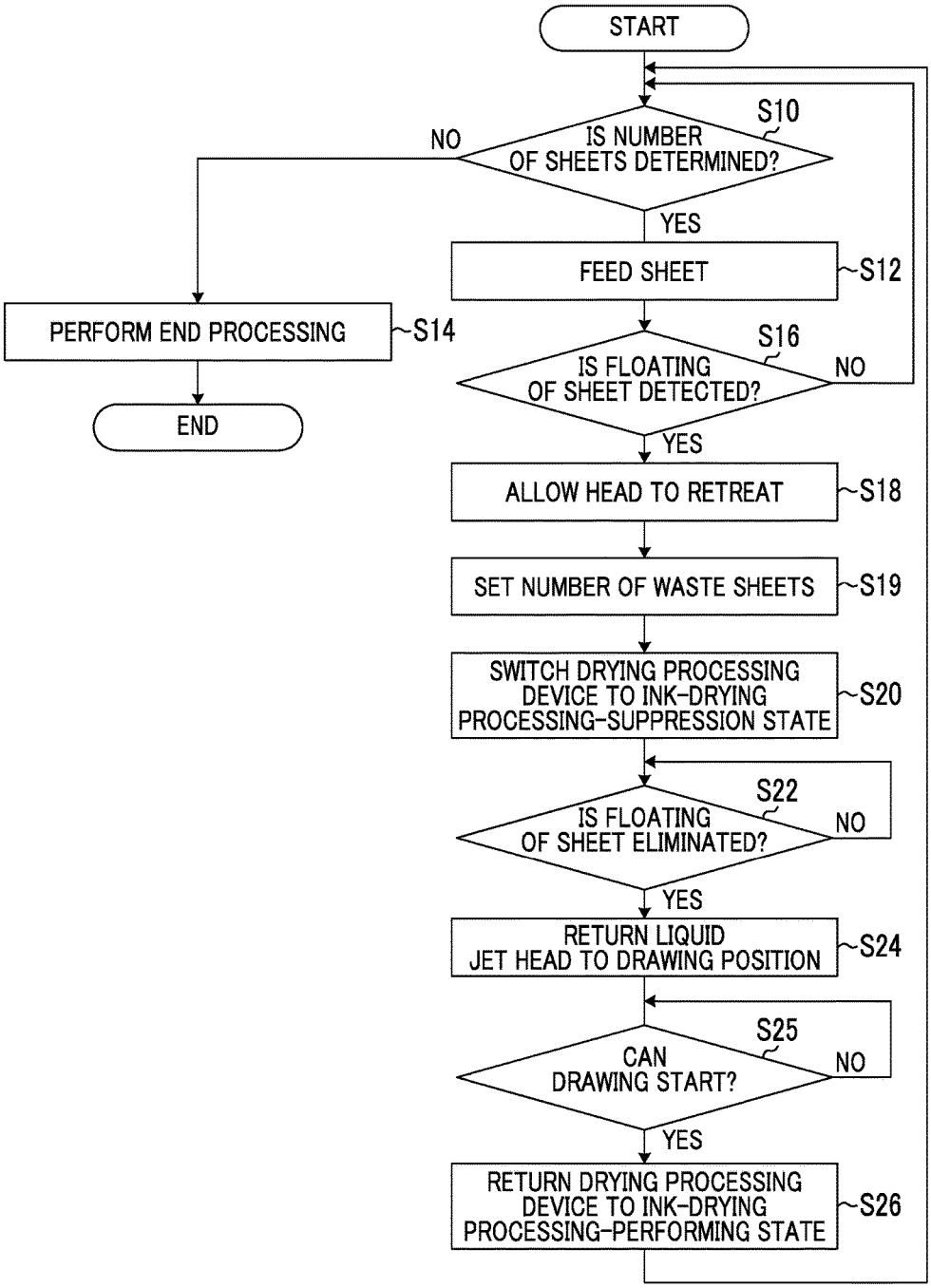
FIG. 10 is a flowchart showing a procedure for coping with the floating of a sheet according to a second embodiment.

FIG. 10 is a flowchart showing a procedure for coping with the floating of a sheet according to the second embodiment. In the flowchart shown in FIG. 10, a drawing-start-possibility determination step S25 is added to the flowchart shown in FIG. 9.

That is, in a case in which the liquid jet heads 56C, 56M, 56Y, and 56K shown in FIG. 1 are moved to the drawing positions from the retreat positions in the head position-return step S24, processing proceeds to the drawing-start-possibility determination step S25 shown in FIG. 10.

It is determined in the drawing-start-possibility determination step S25 whether or not the liquid jet heads 56C, 56M, 56Y, and 56K shown in FIG. 1 satisfy drawing start conditions.

If the liquid jet heads 56C, 56M, 56Y, and 56K shown in FIG. 1 do not satisfy the drawing start conditions in the drawing-start-possibility determination step S25 shown in FIG. 10, the determination of the drawing-start-possibility determination step S25 shown in FIG. 10 is determined as NO. If the determination of the drawing-start-possibility determination step S25 is determined as NO, the determination of whether or not the liquid jet heads 56C, 56M, 56Y, and 56K shown in FIG. 1 satisfy the drawing start conditions is continued in the drawing-start-possibility determination step S25.

If the liquid jet heads 56C, 56M, 56Y, and 56K shown in FIG. 1 satisfy the drawing start conditions in the drawing-start-possibility determination step S25 shown in FIG. 10, the determination of the drawing-start-possibility determination step S25 shown in FIG. 10 is determined as YES. If the determination of the drawing-start-possibility determination step S25 is determined as YES, processing proceeds to the ink-drying processing-performing state-return step S26.

Then, the processing state of the ink-drying processing section 20 shown in FIG. 1 returns to the ink-drying processing-performing state and drawing is resumed.

In the waste sheet-number setting step S19 shown in FIG. 10, the liquid jet heads 56C, 56M, 56Y, and 56K shown in FIG. 1 return to the drawing positions and the number of waste sheets is set in consideration of a period until the liquid jet heads 56C, 56M, 56Y, and 56K shown in FIG. 1 satisfy the drawing start conditions.

Figure 11:
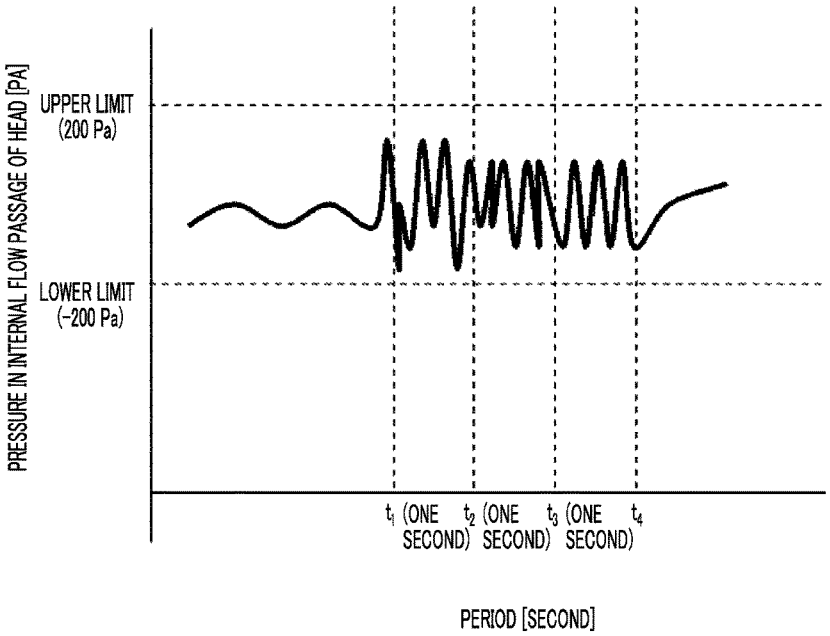
FIG. 11 is a graph illustrating drawing start conditions.

FIG. 11 is a graph illustrating drawing start conditions. An example in which the internal pressures of the liquid jet heads 56C, 56M, 56Y, and 56K shown in FIG. 1 are applied as parameters of the drawing start conditions will be described below.

A horizontal axis of the graph shown in FIG. 11 represents a period. The unit of the horizontal axis of the graph shown in FIG. 11 is second. A vertical axis of the graph shown in FIG. 11 represents a pressure in the internal flow passage of the liquid jet head 56. The unit of the vertical axis of the graph shown in FIG. 11 is Pascal.

The liquid jet head 56, which is mentioned here, is any one of the liquid jet heads 56C, 56M, 56Y, and 56K shown in FIG. 1. The same applies to the following description.

The graph shown in FIG. 11 represents a pressure in the internal flow passage of the liquid jet head 56 in a case in which the liquid jet head 56 is moved up from the drawing position in the vertical direction, is stopped at a stop position above the drawing position, and is moved to the upper side of the stop position in the vertical direction.

In a case in which the upper limit and the lower limit of the pressure in the internal flow passage of the liquid jet head 56 are set and the measured value of a pressure measured by the supply-side pressure sensor 320 shown in FIG. 6 and the measured value of a pressure measured by the collection-side pressure sensor 322 are in the range of the lower limit to the upper limit as shown in FIG. 11, it can be determined that the drawing start conditions are satisfied.

The pressure in the internal flow passage of the liquid jet head 56 shown in FIG. 11 tends to change on the basis of the measured value of a pressure measured by the supply-side pressure sensor 320 shown in FIG. 6 and the measured value of a pressure measured by the collection-side pressure sensor 322.

The liquid jet head 56 starts to be moved up in the vertical direction at $t_1$, is stopped at the stop position above the drawing position at $t_2$, starts to be moved down in the vertical direction at $t_3$, and returns to the drawing position at $t_4$. 1 second is provided as an example of a period between $t_1$ and $t_2$, a period between $t_2$ and $t_3$, and a period between $t_3$ and $t_4$ in FIG. 11.

In FIG. 11, 200 Pa is exemplified as the upper limit of the pressure in the internal flow passage of the liquid jet head 56. Further, −200 Pa is exemplified as the lower limit of the pressure in the internal flow passage of the liquid jet head 56.

The upper limit and the lower limit of the pressure in the internal flow passage of the liquid jet head 56 can be set according to a drawing condition, such as drawing resolution or image quality. Further, the upper limit and the lower limit of the pressure in the internal flow passage of the liquid jet head 56 can be set according to the type of ink.

For example, in a case in which drawing resolution is relatively fine and in a case in which image quality is relatively high, a range between the upper limit and the lower limit of the pressure in the internal flow passage of the liquid jet head 56 may be set to be narrow line.

In regard to the liquid jet heads 56C, 56M, 56Y, and 56K shown in FIG. 1, the same value may be set as the value of the range between the upper limit and the lower limit and different individual values may be set as the value.

In a case in which the liquid jet head 56 is moved in the vertical direction, the jetting state of ink is changed due to a change in the pressure in the internal flow passage and image quality is negatively affected. Accordingly, in a case in which the pressure in the internal flow passage of the liquid jet head 56 is used as the parameter of the drawing start conditions, the deterioration of image quality caused by the retreat of the liquid jet head 56 can be suppressed.

The temperature of liquid in the liquid jet head 56, a period in which the liquid jet head 56 retreats to the retreat position, or the like can be applied as another example of the parameter of the drawing start conditions.

Effects of Second Embodiment

The same effects as the first embodiment can be obtained in the method of coping with the floating of a sheet that is adapted as described above. Further, the liquid jet head 56 retreats in a case in which the floating of a sheet is detected, the liquid jet head 56 returns to the drawing position in a case in which the floating of a sheet is eliminated, and drawing is resumed in a case in which the drawing start conditions are satisfied. Accordingly, it is possible to suppress the deterioration of image quality that is caused by at least one of a case in which the liquid jet head 56 retreats to the retreat position or a case in which the liquid jet head 56 returns to the drawing position. Image quality is one aspect of jetting quality. The drawing start condition is one aspect of a jetting start condition.

Third Embodiment

Next, a method of coping with the floating of a sheet according to a third embodiment will be described. The same components of the method of coping with the floating of a sheet according to the third embodiment to be described below as the components of the methods of coping with the floating of a sheet according to the first and second embodiments will be denoted by the same reference numerals as those of the first and second embodiments, and the description thereof will be appropriately omitted.

Figure 12:
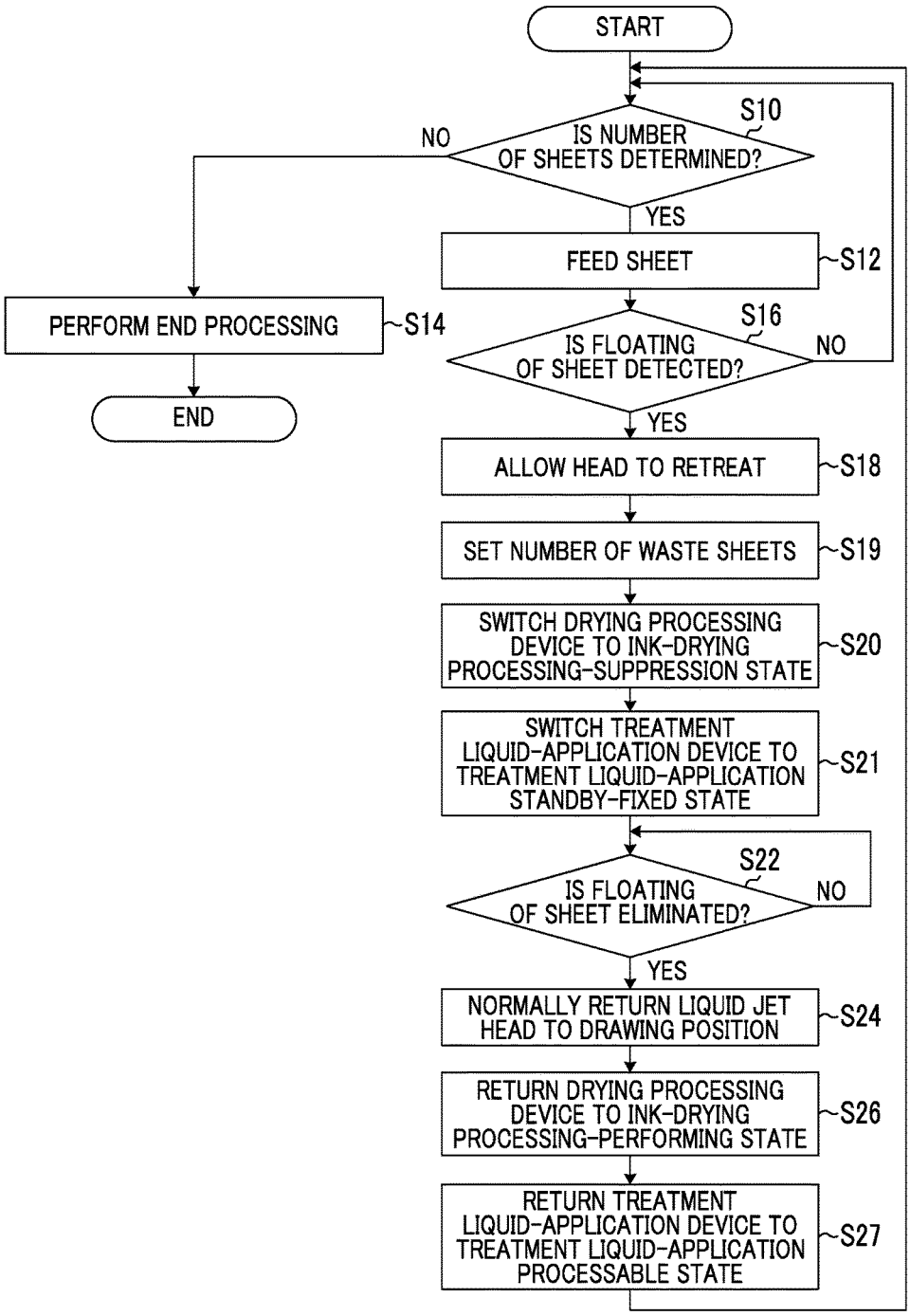
FIG. 12 is a flowchart showing a procedure for coping with the floating of a sheet according to a third embodiment.

FIG. 12 is a flowchart showing a procedure for coping with the floating of a sheet according to the third embodiment. In the flowchart shown in FIG. 12, a treatment liquid-application standby-fixed state switching step S21 and a treatment liquid-application processable state return step S27 are added to the flowchart shown in FIG. 9.

In a case in which the floating of a sheet is detected in the sheet floating detection step S16 and the number of waste sheets set in the waste sheet-number setting step S19 exceeds the number of sheets 36 having passed through the treatment liquid-application section 14 shown in FIG. 1, the treatment liquid-application device 44 of the treatment liquid-application section 14 is switched to a treatment liquid-application standby-fixed state from a treatment liquid-application processable state.

That is, in a case in which sheets 36 not yet subjected to treatment liquid-application processing are included in sheets determined as waste sheets, the treatment liquid is not applied to the sheets determined as waste sheets.

Further, if it is determined in the sheet floating-elimination determination step S22 shown in FIG. 12 that the floating of a sheet is eliminated, the treatment liquid-application device 44 of the treatment liquid-application section 14 is switched to the treatment liquid-application processable state from the treatment liquid-application standby-fixed state after all the sheets 36 determined as waste sheets pass through the treatment liquid-application section 14.

Figure 13:
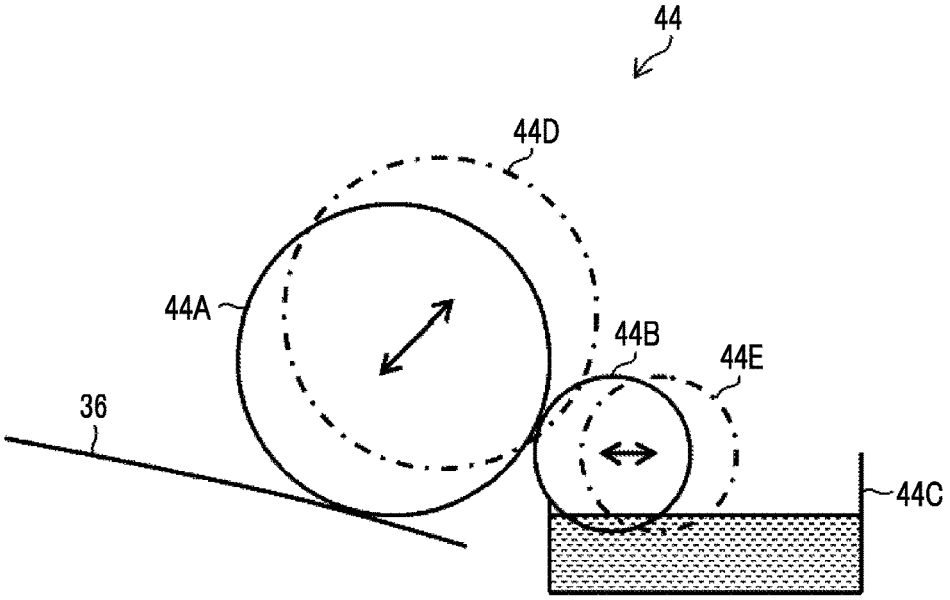
FIG. 13 is a diagram illustrating the operation of a treatment liquid-application device.

FIG. 13 is a diagram illustrating the operation of the treatment liquid-application device. Here, the treatment liquid-application processable state and the treatment liquid-application standby-fixed state of the treatment liquid-application device 44 will be described. The application roller 44A of the treatment liquid-application device 44 shown in FIG. 13 starts to be in contact with a sheet 36 at a timing when the front end of the sheet 36 reaches a treatment liquid-application region.

That is, the treatment liquid-application device 44 moves the application roller 44A to a treatment liquid-application position from a standby position in a case in which the sheet 36 enters the treatment liquid-application region. The standby position is the position of the application roller 44A that is denoted by reference numeral 44D.

The treatment liquid-application region is a region between the position of the rear end of a sheet 36 in a case in which the front end of the sheet 36 reaches the treatment liquid-application position and the position of the front end of the sheet 36 in a case in which the rear end of the sheet 36 reaches the treatment liquid-application position, on the transport path of the sheet 36 in the treatment liquid-application device 44.

The treatment liquid-application position is a position where the application roller 44A is in contact with the sheet 36, and is the position of the application roller 44A that is shown by a solid line.

Further, the treatment liquid-application device 44 allows the application roller 44A to be away from the sheet 36 at a timing when the rear end of the sheet 36 gets out of the treatment liquid-application region. That is, in a case in which the sheet 36 gets out of the treatment liquid-application region, the treatment liquid-application device 44 moves the application roller 44A to the standby position from the treatment liquid-application position. An arrow line given to the application roller 44A indicates the moving direction of the application roller 44A.

Furthermore, the treatment liquid-application device 44 allows the measurement roller 44B to be in contact with the application roller 44A in a period in which treatment liquid is to be supplied to the application roller 44A from the measurement roller 44B. Moreover, the treatment liquid-application device 44 allows the measurement roller 44B to be away from the application roller 44A in a period in which treatment liquid is not to be supplied to the application roller 44A from the measurement roller 44B.

In FIG. 13, the measurement roller 44B, which is present at a position denoted by reference numeral 44E, is the measurement roller 44B that is away from the application roller 44A. A treatment liquid-application standby state may include a state in which the measurement roller 44B is away from the application roller 44A. An arrow line given to the measurement roller 44B of FIG. 13 indicates the moving direction of the measurement roller 44B.

The treatment liquid-application standby-fixed state, which is switched in the treatment liquid-application standby-fixed state switching step S21 shown in FIG. 12, is a state in which the treatment liquid-application device 44 is fixed in the treatment liquid-application standby state in a period in which a sheet 36 passes through the treatment liquid-application region of the application roller 44A shown in FIG. 13.

In a case in which the treatment liquid-application device 44 is fixed in the treatment liquid-application standby state, the treatment liquid is not applied to the sheet 36 passing through the treatment liquid-application region of the application roller 44A.

The treatment liquid-application processable state, which is switched in the treatment liquid-application processable state return step S27 shown in FIG. 12, is a state in which the application roller 44A shown in FIG. 13 is movable between the treatment liquid-application position and the standby position. In the treatment liquid-application processable state, the treatment liquid is applied to the sheet 36 passing through the treatment liquid-application region of the application roller 44A.

In a case in which the floating of a sheet is detected and the treatment liquid-application device 44 of the treatment liquid-application section 14 is switched to the treatment liquid-application standby-fixed state, it is preferable that the treatment liquid-drying processing section 16 is switched to the ink-drying processing-suppression state from the ink-drying processing-performing state.

Further, in a case in which the treatment liquid-application device 44 of the treatment liquid-application section 14 is switched to the treatment liquid-application processable state in the treatment liquid-application processable state return step S27, it is preferable that the treatment liquid-drying processing section 16 is switched to the treatment liquid-drying processing-performing state from the treatment liquid-drying processing-suppression state.

Effects of Third Embodiment

In a case in which the floating of a sheet is detected in the method of coping with the floating of a sheet that is adapted as described above, the treatment liquid-application device 44 of the treatment liquid-application section 14 is in the treatment liquid-application standby-fixed state. Further, in a case in which the floating of a sheet is eliminated, the treatment liquid-application device 44 of the treatment liquid-application section 14 is switched to the treatment liquid-application processable state.

Accordingly, a period between the elimination of the floating of a sheet and a time when drawing can be resumed can be made shorter than that in a case in which a treatment liquid-application processing section is stopped at the time of detection of the floating of the sheet. As a result, the deterioration of production efficiency can be suppressed.

Further, since treatment liquid is not applied in a case in which a sheet 36 determined as a waste sheet passes through the processing region of the treatment liquid-application section 14, the waste sheet to which treatment liquid is not applied can be reused.

Contact type treatment liquid application, which uses the application roller, is exemplified in this embodiment, but an application member, such as a blade or an ink jet head, can also be used.

The third embodiment and the second embodiment are combined with each other, and the internal pressure of the liquid jet head may be applied to the treatment liquid-application device 44 of the treatment liquid-application section 14 under a condition where the treatment liquid-application device 44 of the treatment liquid-application section 14 is switched to the treatment liquid-application processable state from the treatment liquid-application standby-fixed state.

The embodiments of the invention described above can be properly subjected to the modification, addition, and deletion of components without departing from the scope of the invention. The invention is not limited to the above-mentioned embodiments, and can be modified in various ways by those skilled in the art without departing from the scope of the invention.

EXPLANATION OF REFERENCES

10: ink jet recording apparatus
12: sheet feed unit
14: treatment liquid-application section
16: treatment liquid-drying processing section
18: drawing unit
20: ink-drying processing section
21: drying processing device
22: sheet transport member
24: sheet discharge unit
30: stocker
32: sheet feed sensor
34: feeder board
36: sheet
42A, 46A, 52A: rotating shaft
42B, 46B, 52B: outer peripheral surface
42: treatment liquid drum
44: treatment liquid-application device
44A: application roller
44B: measurement roller
44C: treatment liquid container
44D, 44E: standby position
46: treatment liquid-drying processing drum
48: transport guide
50: treatment liquid-drying processing device
52: drawing drum
55: sheet floating sensor
56, 56A, 56C, 56M, 56Y, 56K: liquid jet head
58: in-line sensor
100: system controller
102: communication unit
103: host computer
104: image memory
110: sheet feed control unit
112: transport control unit
114: transport unit
116: treatment liquid-application control unit
117: treatment liquid-drying processing control unit
118: drawing control unit
120: head movement control unit
122: ink-drying processing control unit
124: sheet discharge control unit
126: ink supply control unit
127: ink supply section
130: operation unit
132: display section
134: parameter storage unit
136: program storage unit
140: sheet floating detection unit
142: pressure detection unit
144: waste sheet-number setting unit
146: sensor
200: head module
210: flow passage structure
214: ink supply passage
216: individual supply passage
218: pressure chamber
220: nozzle communication passage
226: individual circulation flow passage
228: common circulation flow passage
230: piezoelectric element
231: piezoelectric layer
232: ink supply chamber
236: ink circulation chamber
252: supply-side individual flow passage
256: collection-side individual flow passage
264: upper electrode
265: lower electrode
266: vibrating plate
267: adhesive layer
275: nozzle plate
277: liquid jetting surface
280: nozzle opening
281: nozzle portion
304: supply-side damper
306: supply-side valve
308: supply-side manifold
309: second supply flow passage
311: supply tank
313: supply pump
314: collection-side damper
316: collection-side valve
318: collection-side manifold
319: second collection flow passage
320: supply-side pressure sensor
321: collection tank
322: collection-side pressure sensor
323: collection pump
325: pump
329: direction-switching valve
329A: first output port
329B: second output port
330: first bypass flow passage valve
332: first bypass flow passage
334: second bypass flow passage valve
336: second bypass flow passage
340: supply-side flow passage
342: supply back pressure tank
360: collection-side flow passage

362: collection back pressure tank
376: supply flow passage valve
377: common flow passage
378: collection flow passage valve
400: head moving unit
402: head support member
404: actuator
S10 to S27: respective steps of method of coping with floating of sheet

What is claimed is:

1. A liquid jetting apparatus comprising:

a medium feed unit that feeds a medium;

a medium transport unit that includes a medium support surface on which the medium fed by the medium feed unit is supported and transports the medium, which is fed by the medium feed unit, in a medium transport direction;

a liquid jet head that jets liquid to the medium transported by the medium transport unit;

a head moving unit that moves the liquid jet head between a liquid jet position where liquid is jetted to the medium and a retreat position which is more distant from the medium transport unit than the liquid jet position;

a liquid-drying processing section that performs drying processing on the medium to which the liquid jetted from the liquid jet head adheres and is disposed at a position on a downstream side of the liquid jet head in the medium transport direction;

a medium floating detection unit that is disposed at a position on an upstream side of the liquid jet head in the medium transport direction, and detects a floating of the medium indicating whether or not at least a part of the medium transported by the medium transport unit is away from the medium support surface by a distance equal to or longer than a predetermined distance;

a medium feed control unit that allows the medium feed unit to continue to feed the medium in a case in which the floating of the medium transported by the medium transport unit is detected by the medium floating detection unit;

a head movement control unit that allows the head moving unit to move the liquid jet head to the retreat position from the liquid jet position in a case in which the floating of the medium transported by the medium transport unit is detected by the medium floating detection unit; and a liquid-drying processing control unit that switches the liquid-drying processing section to a liquid-drying processing-suppression state in which an intensity of drying processing is suppressed in comparison with that in a liquid-drying processing-performing state in which drying processing is performed on the medium, in a case in which the floating of the medium transported by the medium transport unit is detected by the medium floating detection unit.

2. The liquid jetting apparatus according to claim 1, further comprising:

a jetting state detection unit that detects whether or not a state of the liquid jet head is a state in which predetermined jetting quality is obtained, wherein the head movement control unit allows the head moving unit to move the liquid jet head to the liquid jet position from the retreat position in a case in which an elimination of the floating of the medium transported by the medium transport unit is detected by the medium floating detection unit, and the liquid-drying processing control unit switches the liquid-drying processing section to the liquid-drying processing-performing state from the liquid-drying processing-suppression state in a case in which the jetting state detection unit determines that the state of the liquid jet head is a state in which predetermined jetting quality is obtained.

3. The liquid jetting apparatus according to claim 2, wherein the jetting state detection unit includes a pressure detection unit that detects internal pressure of the liquid jet head, and the head movement control unit determines that the state of the liquid jet head is a state in which predetermined jetting quality is obtained in a case in which the elimination of the floating of the medium transported by the medium transport unit is detected by the medium floating detection unit and the internal pressure of the liquid jet head detected by the pressure detection unit is in a predetermined range.

4. The liquid jetting apparatus according to claim 1, further comprising:

a treatment liquid-application section that applies treatment liquid, which aggregates or insolubilizes the liquid jetted to the medium, to the medium and is disposed at a position on an upstream side of the liquid jet head in the medium transport direction; and a treatment liquid-application control unit that controls an operation of the treatment liquid-application section and performs switching between a treatment liquid-application processable state which is a state in which the treatment liquid is capable of being applied to the medium from the treatment liquid-application section and a treatment liquid-application standby-fixed state in which the treatment liquid-application section is fixed in a treatment liquid-application standby state which is a state in which the treatment liquid is not applied to the medium from the treatment liquid-application section, wherein the treatment liquid-application control unit switches the treatment liquid-application section to the treatment liquid-application standby-fixed state from the treatment liquid-application processable state in a case in which the floating of the medium is detected by the medium floating detection unit.

5. The liquid jetting apparatus according to claim 4, wherein the treatment liquid-application section includes an application member that is in contact with the medium to apply the treatment liquid to the medium, and in a case in which the treatment liquid-application section is in the treatment liquid-application processable state, the treatment liquid-application control unit moves the application member from a standby position, which is distant from a treatment liquid-application position where the application member and the medium are in contact with each other, to the treatment liquid-application position at a timing when the medium enters a treatment liquid-application region of the treatment liquid-application section and moves the application member to the standby position from the treatment liquid-application position at a timing when the medium gets out of the treatment liquid-application region of the treatment liquid-application section.

6. The liquid jetting apparatus according to claim 5, wherein the treatment liquid-application control unit switches the treatment liquid-application section to the treatment liquid-application processable state from the treatment liquid-application standby-fixed state in a case in which an elimination of the floating of the medium transported by the medium transport unit is detected by the medium floating detection unit.

7. The liquid jetting apparatus according to claim 4, further comprising:

a treatment liquid-drying processing section that performs drying processing on the medium to which the treatment liquid is applied by the treatment liquid-application section and is disposed at a position on a downstream side of the treatment liquid-application section in the medium transport direction and on an upstream side of the liquid jet head in the medium transport direction; and a treatment liquid-drying processing control unit that switches the treatment liquid-drying processing section to a treatment liquid-drying processing-suppression state in which an intensity of drying processing is suppressed in comparison with that in a treatment liquid-drying processing-performing state in which drying processing is performed on the medium, in a case in which the floating of the medium transported by the medium transport unit is detected by the medium floating detection unit.

8. The liquid jetting apparatus according to claim 7, further comprising:

a jetting state detection unit that detects whether or not a state of the liquid jet head is a state in which predetermined jetting quality is obtained, wherein the treatment liquid-drying processing control unit switches the treatment liquid-drying processing section to the treatment liquid-drying processing-performing state from the treatment liquid-drying processing-suppression state in a case in which the jetting state detection unit determines that the state of the liquid jet head is a state in which predetermined jetting quality is obtained.

9. The liquid jetting apparatus according to claim 1, wherein the liquid-drying processing section includes a heater radiating heat, and the liquid-drying processing control unit suppresses radiant energy of heat radiated from the heater in comparison with radiant energy of heat, which is radiated from the heater in the liquid-drying processing-performing state, at a timing when the liquid-drying processing control unit switches the liquid-drying processing section to the liquid-drying processing-suppression state.

10. The liquid jetting apparatus according to claim 1, wherein the liquid-drying processing section includes a fan that generates wind, and the liquid-drying processing control unit suppresses a flow rate of air sent from the fan in comparison with a flow rate of air, which is sent from the fan in the liquid-drying processing-performing state, at a timing when the liquid-drying processing control unit switches the liquid-drying processing section to the liquid-drying processing-suppression state.

11. The liquid jetting apparatus according to claim 1, wherein the liquid jet head is an ink jet head that jets ink to a medium.

12. The liquid jetting apparatus according to claim 1, further comprising:

a waste sheet-number setting unit that sets the number of mediums passing through a liquid jet region of the liquid jet head in a head retreat period between a timing when the liquid jet head is moved to the retreat position from the liquid jet position by the head moving unit and a timing when the liquid jet head is moved to the liquid jet position from the retreat position by the head moving unit, by using the head retreat period, a feed timing of the medium fed by the medium feed unit, and a transport speed of the medium transported by the medium transport unit, wherein the liquid-drying processing control unit switches the liquid-drying processing section to the liquid-drying processing-suppression state in a period in which mediums of which the number is set by the waste sheet-number setting unit from mediums detected by the medium floating detection unit pass through a drying processing region of the liquid-drying processing section.

13. A method of coping with floating of a medium, the method comprising:

a medium feeding step of feeding a medium;

a liquid jetting step of jetting liquid to the medium, which is fed in the medium feeding step and is transported by a medium transport unit, by a liquid jet head, the medium transport unit including a medium support surface on which the medium fed in the medium feeding step is supported and transporting the medium in a medium transport direction;

a liquid-drying processing step of performing drying processing on the medium, to which the liquid jetted from the liquid jet head adheres, at a position on a downstream side of the liquid jet head in the medium transport direction;

a medium floating detection step of detecting a floating of the medium, which indicates whether or not at least a part of the medium transported by the medium transport unit is away from the medium support surface by a distance equal to or longer than a predetermined distance, at a position on an upstream side of the liquid jet head in the medium transport direction; and a head moving step of moving the liquid jet head between a liquid jet position where the liquid is jetted to the medium and a retreat position that is more distant from the medium transport unit than the liquid jet position, wherein in a case in which the floating of the medium transported by the medium transport unit is detected in the medium floating detection step, the medium continues to be fed in the medium feeding step, the head moving step is performed to move the liquid jet head to the retreat position from the liquid jet position, and a state is switched to a liquid-drying processing-suppression state in which an intensity of drying processing is suppressed in comparison with that in a liquid-drying processing-performing state in which drying processing is performed on the medium in the liquid-drying processing step.

* * * * *